US012628948B2

(12) United States Patent
Norquist et al.

(10) Patent No.: US 12,628,948 B2
(45) Date of Patent: May 19, 2026

(54) MODULAR TABLES WITH ATTACHED SEAT(S)

(71) Applicant: PlayCore Wisconsin, Inc., Chattanooga, TN (US)

(72) Inventors: Thomas Robert Norquist, Fort Payne, AL (US); Jacob Arbeiter, Red Bud, IL (US); Austin Miller, Red Bud, IL (US)

(73) Assignee: PlayCore Wisconsin, Inc., Chattanooga, TN (US)

( * ) Notice: Subject to any disclaimer, the term of this patent is extended or adjusted under 35 U.S.C. 154(b) by 190 days.

(21) Appl. No.: 18/407,736

(22) Filed: Jan. 9, 2024

(65) Prior Publication Data

US 2025/0221525 A1 Jul. 10, 2025

(51) Int. Cl.

| | |
|---|---|
| ***A47B 83/02*** | (2006.01) |
| ***A47B 13/08*** | (2006.01) |
| ***A47B 13/10*** | (2006.01) |

(52) U.S. Cl.

CPC ..... *A47B 83/024* (2017.08); *A47B 13/088* (2013.01); *A47B 13/10* (2013.01)

(58) Field of Classification Search

CPC ..... A47B 3/063; A47B 3/14; A47B 39/00; A47B 83/02; A47B 83/023; A47B 83/024

USPC ..... 297/158.5, 158.3, 158.1

See application file for complete search history.

(56) References Cited

U.S. PATENT DOCUMENTS

| | | | | |
|---|---|---|---|---|
| D169,012 | S | 3/1953 | Musacco | |
| D178,989 | S | 10/1956 | Eilert | |
| 3,053,598 | A | 9/1962 | Cheslow | |
| 3,533,362 | A * | 10/1970 | Ives | A47B 17/00 312/195 |

(Continued)

FOREIGN PATENT DOCUMENTS

| | | | |
|---|---|---|---|
| CA | 231754 | | 4/2025 |
| CN | 118680384 | * | 9/2024 |

(Continued)

OTHER PUBLICATIONS

Multi-Table, posted Jan. 18, 2025 [online], [retrieved Jun. 10, 2025]. Retrieved from internet, https://www.ultra-site.com/products/tables/multi-table (Year: 2025).

(Continued)

*Primary Examiner* — Jose V Chen

(74) *Attorney, Agent, or Firm* — McAndrews, Held & Malloy, Ltd.

(57) ABSTRACT

The present disclosure relates to a set of components configured to be assembled together to produce a variety of different modular tables and the modular tables that are produced. The components and resulting tables may include at least one tabletop component; at least one seating surface; and at least one leg having a first end that can be affixed to an underside of the tabletop, a second end that can be affixed to an underside of the seating surface, and a central portion that is configured to rest on a ground surface. The components are configured so that a leg may be affixed to the tabletop at different locations, e.g. to produce different (Continued)

seating positions. Moreover, at least one of the tabletop components may be an "L"-shaped tabletop, which allows for the design of a large variety of different table and seating configurations.

20 Claims, 26 Drawing Sheets

(56) References Cited

U.S. PATENT DOCUMENTS

| | | | | |
|---|---|---|---|---|
| 3,741,852 | A * | 6/1973 | Keener | A47B 87/002 428/80 |
| D244,409 | S | 5/1977 | Arnold | |
| 4,289,350 | A * | 9/1981 | Thomas | A47B 3/14 108/174 |
| 4,522,443 | A * | 6/1985 | Van Blankenburg | A47B 83/02 297/158.3 |
| D283,563 | S | 4/1986 | Arroyo | |
| 4,772,018 | A * | 9/1988 | Inniger | A63B 67/04 473/475 |
| 4,986,194 | A * | 1/1991 | Bollman | A47B 17/02 108/60 |
| 5,016,405 | A * | 5/1991 | Lee | A47B 83/001 52/239 |
| 5,253,595 | A * | 10/1993 | Heidmann | A47B 87/002 108/64 |
| 5,314,231 | A | 5/1994 | Otterbacher | |
| 5,421,270 | A | 6/1995 | Kelly | |
| D368,807 | S | 4/1996 | Noll | |
| D369,913 | S | 5/1996 | Noll | |
| D379,273 | S | 5/1997 | Sims | |
| 5,752,450 | A * | 5/1998 | Roesner | A47B 83/02 297/157.1 |
| D398,452 | S | 9/1998 | Reddig | |
| 5,992,332 | A * | 11/1999 | Grabowski | A47B 13/10 108/50.01 |
| 6,102,475 | A | 8/2000 | Hamann | |
| 6,116,681 | A * | 9/2000 | Borglum | A47B 37/00 297/157.1 |
| 6,186,590 | B1 * | 2/2001 | Tseng | A47B 3/14 297/158.3 |
| 6,588,030 | B1 * | 7/2003 | Wulff | A47K 3/281 D6/532 |
| 6,629,723 | B1 * | 10/2003 | Trubee | A47B 83/02 297/158.3 |
| 6,883,864 | B2 * | 4/2005 | Gregory | A47B 3/14 297/158.4 |
| 6,918,630 | B1 * | 7/2005 | Thomas | A47B 83/02 297/157.1 |
| D579,676 | S | 11/2008 | Rheault et al. | |
| D604,521 | S | 11/2009 | Wegman | |
| D605,862 | S | 12/2009 | Weeks | |
| 8,904,714 | B2 * | 12/2014 | Montalto | E04G 21/3209 52/79.5 |
| D746,087 | S | 12/2015 | Dart et al. | |
| D761,029 | S * | 7/2016 | Behar | D6/378 |
| D765,815 | S | 9/2016 | Newman et al. | |
| D829,008 | S | 9/2018 | Tamura | |
| D841,994 | S | 3/2019 | Wynants | |
| D846,292 | S | 4/2019 | Wynants | |
| D932,818 | S | 10/2021 | Dart et al. | |
| D985,286 | S | 5/2023 | Kirn | |
| D1,019,164 | S | 3/2024 | Torres Torres et al. | |
| D1,051,621 | S | 11/2024 | Udagawa et al. | |
| D1,055,592 | S | 12/2024 | Krusin | |
| 2002/0020329 | A1 * | 2/2002 | Kowalski | A47B 21/00 108/50.01 |
| 2004/0108756 | A1 * | 6/2004 | Winter | A47B 37/04 297/158.3 |
| 2005/0115474 | A1 * | 6/2005 | Chang | A47B 17/06 108/64 |
| 2006/0181114 | A1 * | 8/2006 | Nye | A47B 37/04 297/158.3 |
| 2016/0206090 | A1 | 7/2016 | Feeley et al. | |
| 2021/0177135 | A1 * | 6/2021 | Leng | A47B 3/14 |
| 2021/0274929 | A1 * | 9/2021 | Choi | A47B 3/14 |
| 2021/0274930 | A1 * | 9/2021 | Choi | A47B 3/0913 |
| 2022/0047070 | A1 * | 2/2022 | Fauley | A47B 83/023 |
| 2024/0023704 | A1 * | 1/2024 | Jiang | A47B 3/14 |
| 2025/0089887 | A1 * | 3/2025 | Samikkannu | A47B 3/002 |

FOREIGN PATENT DOCUMENTS

| | | |
|---|---|---|
| GB | 4004350 | 10/2007 |
| GB | 6341720 | 1/2024 |
| JP | D1713370 | 4/2022 |
| KR | 301022805.0000 | 9/2019 |
| KR | 301073111.000 | 9/2020 |
| RU | 00133897 | 11/2022 |
| WO | D206395-001 | 6/2020 |

OTHER PUBLICATIONS

Collaboration Station, posted Jan. 18, 2025 [online], [retrieved Jun. 10, 2025]. Retrieved from internet, https://www.ultra-site.com/products/tables/collaboration-station (Year: 2025).

Canteen Tables, posted date not available [online], [retrieved Jun. 10, 2025]. Retrieved from internet, https://www.belson.com/Perforated-Steel-Canteen-Table?utm_source=google&utm_medium=cpc&utm_campaign=SHOPPING (Year: 2025).

City Design Zoid S, posted date not available [online], [retrieved Jun. 10, 2025]. Retrieved from internet, https://www.archiproducts.com/en/products/city-design/round-steel-table-for-public-areas-with-integrated-seat-zoid-s_664461 (Year: 2025).

Transforma-Desk, posted Apr. 7, 2025 [online], [retrieved Jun. 10, 2025]. Retrieved from internet, https://www.playcraftsystems.com/product-details/transforma-desk (Year: 2025).

Social Distancing Outdoor Classroom Desk, posted Oct. 31, 2020 [online], [retrieved Jun. 10, 2025]. Retrieved from internet, https://www.furnitureleisure.com/social-distancing-outdoor-classroom-desk-with-thermoplastic-finish (Year: 2020).

Pair of Aksel Kjersgaard Coffee Tables, posted Sep. 27, 2023 [online], [retrieved Jun. 10, 2025]. Retrieved from internet, https://studiocadmium.com/catalogue/archive/pair-of-aksel-kjersgaard-coffee-tables-for-odder-furniture/ (Year: 2023).

* cited by examiner

Diagonal J Leg

Straight Split Leg

Right Split Leg

High Table J Leg

Med U Leg

MODULAR TABLES WITH ATTACHED SEAT(S)

SUMMARY OF THE INVENTION

Embodiments of the present disclosure are directed to modular tables that can be assembled in a variety of different configurations to produce numerous table and seat combinations.

At least one of the modular tables may include an "L"-shaped tabletop component. The "L"-shaped tabletop component has a central portion, a first wing portion, and a second wing portion, each of the first and second wing portions extending from the central portion at a 90 degree angle to one another to produce the "L"-shape. The modular table may also include one or more seating surfaces connected to the tabletop component. More particularly, each of the one or more seating surfaces may be connected to the tabletop component by a leg having a first end affixed to an underside of the tabletop component and a second end affixed to an underside of the seating surface. The underside of the tabletop component may be configured so that the first end of each of the one or more legs may be attached at a plurality of different locations, for example to any of the central portion, the first wing portion, or the second wing portion.

In some embodiments, the underside of the tabletop component may include at least a first rail and second rail and the first end of the leg may have a mounting plate that is configured to fit between the first and second rails. To affix the leg to the underside of the tabletop component, therefore, the mounting plate may be positioned between the first and second rails, a first side of the mounting plate may be secured to the first rail, e.g. by one or more fasteners, and a second opposing side of the mounting plate may be secured to the second rail, e.g. by one or more fasteners.

In some embodiments, each leg may include a first portion extending downward from the first end, a second portion extending downward from the second end, and a central portion of the leg that extends horizontally between the first and second portions and which is configured to rest on a ground surface.

In some embodiments, the modular table may include a split leg in which first and second seating surfaces are connected to the tabletop component by a single mounting plate. Such an embodiment may include a first seating surface and a first leg, the first leg having an end (second end) affixed to an underside of the first seating surface, and a second seating surface and a second leg, the second leg having an end (second end) affixed to an underside of the second seating surface. However, the other end (first end) of the first leg and the other end (first end) of the second leg share a single mounting plate that is affixed to the underside of the tabletop element, e.g. as described herein.

In some modular table configurations, at least one of the one or more seating surfaces may be configured to support a single occupant. Such a seating surface may be positioned at a variety of positions around the tabletop component. For instance, a single occupant seat may be positioned in between the first and second wing portions of the "L"-shaped tabletop component, at an outer side of the first wing portion, or at an outer side of the second wing portion. Moreover, where the seating surface is positioned between the first and second wing portions, the first end of the leg may be affixed to the underside of the table at numerous different locations. For instance, the first end of the leg may be affixed to the underside of the "L"-shaped tabletop component at the center portion, such that the leg forms an angle of about 45 degrees with both the first wing portion and the second wing portion; at the first wing portion, such that the leg extends parallel to the second wing portion; or at the second wing portion, such that the leg extends parallel to the first wing portion.

In some modular table configurations, at least one of the one or more seating surfaces may be configured to support multiple (for example two) occupants. Such a seating surface may be connected to the tabletop component by more than one leg. For instance, such a seating surface may be connected to the tabletop component by a first leg having a first end affixed to an underside of the tabletop component and a second end affixed to an underside of the seating surface, and a second leg having a first end affixed to an underside of the tabletop component and a second end affixed to an underside of the seating surface. The multiple-occupant seat may also be positioned at a variety of positions around the "L"-shaped tabletop component, such as along an outer side of the tabletop component formed by a combination of the first wing portion and the central portion and along an outer side of the tabletop component formed by a combination of the second wing portion and the central portion.

In some modular table configurations, the modular table may include multiple "L"-shaped tabletop components. For instance the modular table may have a first "L"-shaped tabletop component and a second "L"-shaped tabletop component.

The first and second "L"-shaped tabletop components may be secured to one another by a connector having a first end affixed to an underside of the first tabletop component and a second end affixed to an underside of the second tabletop component. The connector may be configured similarly to a leg used to secure a seat to a tabletop component. For instance, the connector may include a first portion extending downward from the first end, a second portion extending downward from the second end, and a central portion that extends horizontally between the first and second portions and which is configured to rest on a ground surface. The connector may also be affixed to the undersides of the first and second tabletop components similarly to a leg. For instance, the first end of the connector may have a mounting plate that is positioned between and secured to first and second rails that are present on the underside of the first tabletop component and the second end of the connector may have a mounting plate that is positioned between and secured to first and second rails that are present on the underside of the second tabletop component.

Alternatively, the first and second "L"-shaped tabletop components may be secured to one another by fastening together adjacent side edges of the two tabletop components. For instance, each of the first and second "L"-shaped tabletop components may have side edges, e.g. that extend downward from the tabletop surface around its periphery, that each includes one or more apertures. A side edge of the first "L"-shaped tabletop component and a side edge of the second "L"-shaped tabletop component may thus be secured together by one or more fasteners (e.g. bolts, screws, pins, or the like) that extend through the one or more apertures of the aligned side edges. Other types of fasteners, such as clips, which would not require the side edge apertures are also contemplated without departing from the scope of the present disclosure.

In some modular table configurations, a first "L"-shaped tabletop component and a second "L"-shaped tabletop component may be positioned at different heights. In some embodiments, for instance, the height of the second "L"-shaped tabletop component may differ from the height of the first "L"-shaped tabletop component by at least eight inches. In some embodiments, for instance, the height of the second "L"-shaped tabletop component may differ from the height of the first "L"-shaped tabletop component by about twelve inches, i.e. one foot. In some embodiments one of the first and second "L"-shaped tabletop component may be positioned at a height that is configured for use by a person in a wheelchair, and at least one side of that tabletop component may be free of obstructions such a person in a wheelchair can position his or her legs under the table top. Regardless of the height differential, the first and second "L"-shaped tabletop components may, in some embodiments, be arranged so that they form a rectangular shape when viewed from above.

Where the first and second "L"-shaped tabletop components are positioned at different heights, they may be secured together by a connector having a first end affixed to an underside of the first tabletop component and a second end affixed to an underside of the second tabletop component, e.g. as described above. Specifically, the first end of the connector and the second end of the connector may be positioned at different heights above the central portion that is configured to rest on the ground surface.

In some modular table configurations, a first "L"-shaped tabletop component and a second "L"-shaped tabletop component may be positioned at the same height. Where the first and second "L"-shaped tabletop components are positioned at the same height, they may be secured together by a connector having a first end affixed to an underside of the first tabletop component and a second end affixed to an underside of the second tabletop component, by the side edges of the first and second tabletop components being secured together, or both. In some embodiments, the first and second "L"-shaped tabletop components may be secured together by their side edges and each of the first and second "L"-shaped tabletop components may include one or more seating surfaces, each of which is connected to the tabletop component by a leg having a first end affixed to an underside of the tabletop component and a second end affixed to an underside of the seating surface, and the central portion of the legs may be the only surfaces of the modular table in contact with the ground surface.

Embodiments of the present disclosure are also directed to a set of modular components configured to be assembled in different ways to produce a variety of different table and seating configurations.

The set of modular components may include one or more "L"-shaped tabletop components, each of which includes a central portion, a first wing portion, and a second wing portion, each of the first and second wing portions extending from the central portion at a 90 degree angle to one another to form the "L" shape; one or more seating surfaces configured to support a single occupant, one or more seating surfaces configured to support multiple occupants, or a combination thereof; and one or more legs, each leg having a first end that comprises a mounting plate configured to be affixed to an underside of any of the plurality of "L"-shaped tabletop components and a second end that is configured to be affixed to any of the one or more seating surfaces. The underside of each of the one or more "L"-shaped tabletop components may be configured for the mounting plate of each of the one or more legs to be affixed at locations on the central portion, the first wing portion, and the second wing portion, thereby providing each tabletop component with a variety of potential seating arrangements.

In some embodiments, each of the one or more legs may be a "J"-shaped leg that comprises a first portion extending downward from the first end, a second portion extending downward from the second end, and a central portion that extends horizontally between the first and second portions and which is configured to rest on a ground surface.

In some embodiments, the underside of each of the plurality of tabletop components may include at least a first rail to which a first side of the mounting plate of any of the legs may be secured by one or more fasteners and a second rail to which a second, opposing side of the mounting plate of any of the legs may be secured by one or more fasteners. In some embodiments, the underside of each of the plurality of tabletop components may further include a third rail to which a first side of the mounting plate of any of the legs may be secured by one or more fasteners and a fourth rail to which a second, opposing side of the mounting plate of any of the legs may be secured by one or more fasteners.

The set of modular components may also include one or more "U"-shaped connector elements, one or more "J"-shaped connector elements, or both. Each of the one or more "U"-shaped and/or "J"-shaped connector elements may have a first end with a first mounting plate configured to be affixed to the underside of any of the plurality of tabletop components and a second end with a second mounting plate configured to be affixed to the underside of any other of the plurality of tabletop components to secure two tabletop components together.

The "U"-shaped connector is configured to secure two tabletop components at the same height whereas the "J"-shaped connector is configured to secure to tabletop components at different heights. In some embodiments, for instance, the first end of a "J"-shaped connector may be positioned at least eight inches above a second end of the "J"-shaped connector, for example about twelve inches above the second end. Where the set of modular components is configured such that the tabletop components may be positioned at different heights, the set of modular components may further include legs configured to provide seating surfaces at different heights. For instance, the set of modular components may include a first leg configured to position a seating surface at a first height (e.g. for use with a higher tabletop component) and a second leg configured to position a seating surface at a second, lower height (e.g. for use with a lower tabletop component). In some embodiments, the height differential of the first and second legs may correspond with the height differential of the "J"-shaped tabletop connector, i.e. such that the distance between each seating surface and the tabletop component to which it is connected is substantially the same.

In some embodiments, the set of modular components may be configured such that the rails on the underside of each of the tabletop components may be used to secure any of the legs or any of the connector elements. In some embodiments, each of the tabletop components in the set of modular components may have side edges that include one or more apertures by which any two of the tabletop components can be secured together.

In some embodiments, the set of modular components may further include one or more square tabletop components, one or more rectangular tabletop components, or both. The underside of each of the one or more square and/or rectangular tabletop components may be configured for the mounting plate of any of the legs to be attached at a plurality of different locations. For instance, each of the one or more square and/or rectangular tabletop components may include at least first and second rails to which the mounting plate of any of the legs may be fastened. In some embodiments, the underside of each of the one or more square and/or rectangular tabletop components may be configured for the mounting plate of any of the legs or the mounting plate of any of the connector elements to be attached at a plurality of different locations. In some embodiments, each of the square and/or rectangular tabletop components in the set of modular components may have side edges that include one or more apertures by which any two of the tabletop components can be secured together.

In some embodiments, the one or more legs may include a leg in which the mounting plate is configured to be affixed to an underside of any of the plurality of "L"-shaped tabletop components at a central portion of the tabletop component, such that the leg extends diagonally into the space between the first wing portion and the second wing portion. In some embodiments, the one or more legs may include a split leg, in which two "J"-shaped legs extend in different directions from the same mounting plate.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Embodiments of the present disclosure are directed to modular tables 100 and sets of modular components that are configured to be assembled into any of those tables. Examples of components that may be included in a set of modular components which are configured to be assembled into any of a variety of tables 100 are shown in FIGS. 1A to 5B. FIGS. 6A to 16C show examples of unique tables 100 that can be assembled with the modular components. While certain tables 100 have been provided as examples, it should be understood that these are provided as exemplary embodiments and that a person of skill in the art would understand that additional tables of differing designs could also be assembled using the set of modular components described herein.

Figure 1A:
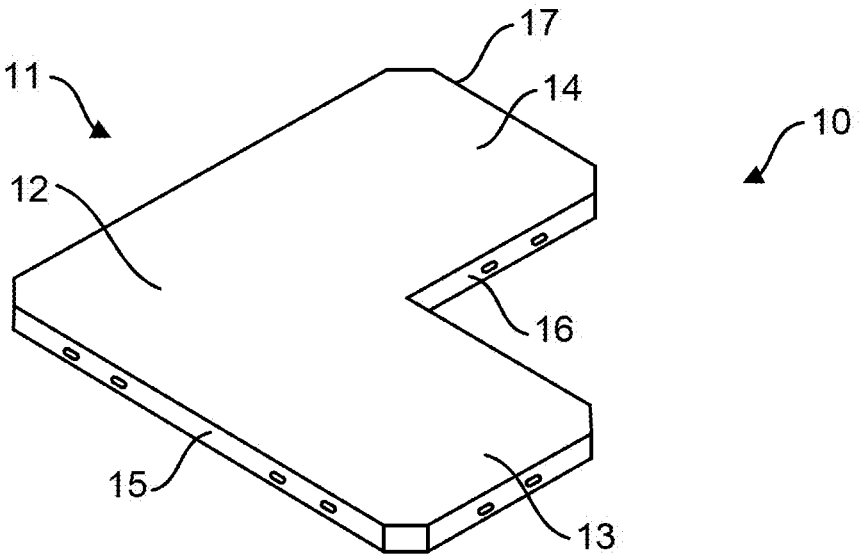
FIG. 1A is perspective view of an "L"-shaped tabletop in accordance with an embodiment of the present disclosure.
Figure 1B:
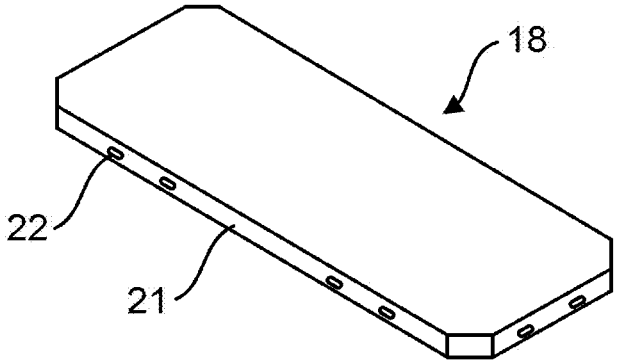
FIG. 1B is perspective view of a rectangular tabletop in accordance with an embodiment of the present disclosure.
Figure 1C:
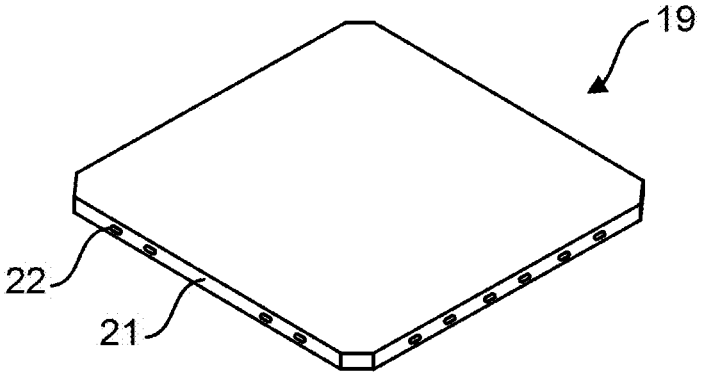
FIG. 1C is perspective view of a square tabletop in accordance with an embodiment of the present disclosure.

FIGS. 1A to 1C show samples of modular tabletop components 10 that can be included in a set of components that is configured and used to assemble modular tables with attached seats, such as those described and shown herein.

FIG. 1A shows an embodiment of an "L"-shaped tabletop component 11. The "L"-shaped tabletop component comprises a center portion 12, a first wing portion 13, and a second wing portion 14. The first wing portion 13 and the second wing portion 14 extend in directions that are 90° to each other. The "L"-shaped tabletop comprises outer side edges 15 and inner side edges 16. The outer side edges 15 include a first outer side edge formed by the outer periphery of the first wing portion 13 and the center portion 12 from which it extends and a second outer side edge formed by the outer periphery of the second wing portion 14 and the center portion from which it extends. The inner side edges 16 include a first inner side edge formed by the inner periphery of the first wing portion 13 and a second inner side edge formed by the inner periphery of the second wing portion 14. The "L"-shaped tabletop also includes end edges 17, the first end edge being defined by the farthest extent of the first wing portion from the central portion 12 and the second end edge being defined by the farthest extent of the second wing portion from the central portion.

One or more "L"-shaped tabletop components 11 can be used to provide a huge variety of possible unique table designs. Moreover, by placing a seat in the space formed between the inner side edges 16 of the first and second wing portions 13, a unique table having a seat that offers a high degree of personal space can be provided.

FIG. 1B shows an embodiment of a rectangular tabletop component 18, one or more of which may be used as a standalone tabletop or to extend the length and/or width of a table design. FIG. 1C shows an embodiment of a square tabletop component 19, one or more of which may be used as a standalone tabletop or to extend the length and/or width of a table design. While only the three tabletop shapes are shown, additional tabletop shapes (and variations on the illustrated shapes) are contemplated without departing from the scope of the present disclosure.

In the illustrated embodiments, each tabletop 11, 18, 19 is shown as having an upper surface made up of a single integral material. In other (non-illustrated) embodiments, however, the upper surface of any of the tabletops 11, 18, 19 may be made up of more than one material or component attached together to form a continuous or substantially continuous upper surface.

In some embodiments, including for instance the illustrated embodiments, the corners of each tabletop 11, 18, 19 may be beveled so as to avoid sharp corners. However, tabletops having conventional squared corners may also be provided.

As shown in FIGS. 1A to 1C, the peripheral edges of all of the tabletops 10 may include flanges 21, which extend a small distance downward from the upper surface of the tabletop. At least one, and desirably each, flange 21 may include one or more, and preferably a plurality, of apertures 22, each of which is configured to receive a conventional fastener, such as a bolt. This allows any of the tabletop 10 to be connected to any other tabletop from the modular set of components simply by aligning the apertures 22 of adjacent flanges 21 and securing the two flanges together, e.g. by passing a bolt or other fastener through the aligned apertures. By including flanges 21 with apertures 22 on each edge of the tabletops 10, the various tabletops can be secured together in substantially any arrangement to form a table having any of a large variety of shapes. The apertures 22 on free ends of a table assembly (i.e. those not being used to secure tabletop components together) may be used to attach accessories (not illustrated) such as hooks, accessibility handles, etc.

Figure 2A:
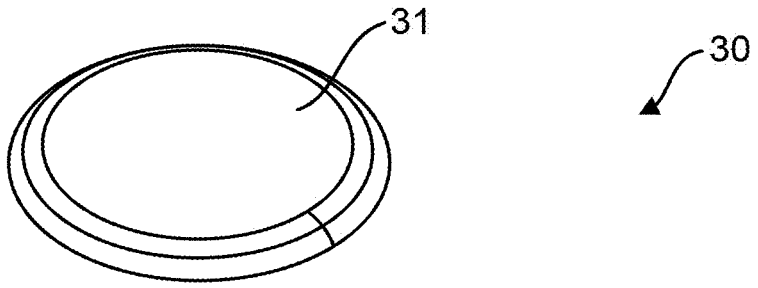
FIG. 2A is a perspective view of a single-occupant seat according to an embodiment of the present disclosure.
Figure 2B:
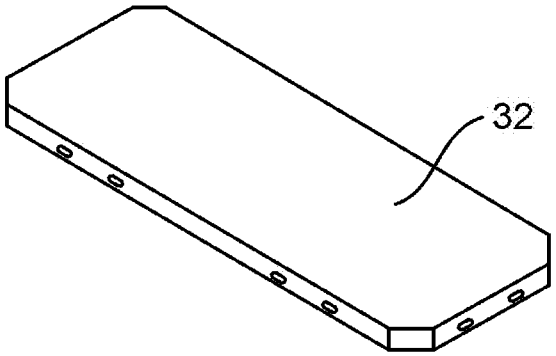
FIG. 2B is a perspective view of a multiple-occupant bench seat according to an embodiment of the present disclosure.

FIGS. 2A to 2B show samples of modular seat components 30 that can be included in a set of components that is configured and used to assemble modular tables with attached seats, such as those described and shown herein.

FIG. 2A shows an embodiment of a seat 31 that is configured to support a single occupant. As shown in the illustrated embodiment, seat 31 may be circular and may have no back support. In other, non-illustrated embodiments, however, the seat may have other shapes and/or may have a back support. FIG. 2B shows an embodiment of a seat 32 that is configured to support multiple occupants. As shown in the illustrated embodiment, seat 32 may be a bench seat having a length that is sufficient to support at least two occupants in a side-by-side relationship. In some embodiments, the length of the seat 32 may correspond with the length of an outer side edge 15 of the "L"-shaped tabletop 11, with the length of the side edge of the square tabletop 19, with the length of the rectangular tabletop 18, or desirably all three. In some embodiments, in fact, the same component may be used as either a rectangular tabletop 18 or a bench seat 32 (or both) in a modular table. The underside of each seat 30 provided in the set of components is configured to be affixed to a leg 40, by which the seat may be attached to at least one of the tabletops 10. While only the two seat shapes are shown, additional seat shapes (and variations on the illustrated shapes) are contemplated without departing from the scope of the present disclosure.

Figure 3A:
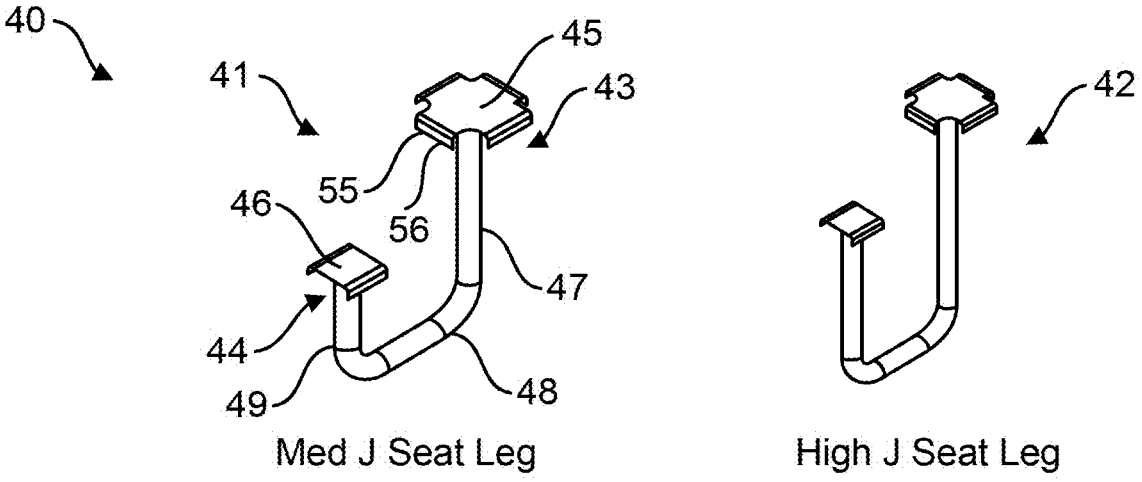
FIG. 3A is a perspective view of "J"-shaped legs according to an embodiment of the present disclosure, showing first and second legs having different heights.
Figure 3B:
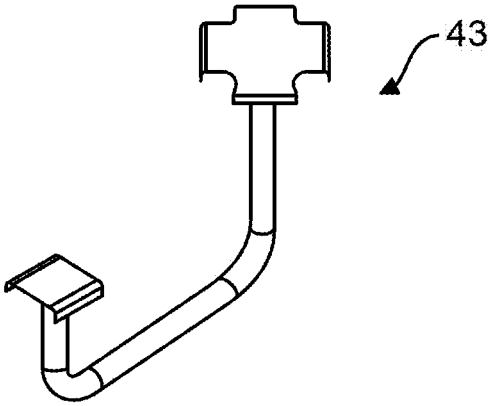
FIG. 3B is a perspective view of a "J"-shaped leg according to an embodiment of the present disclosure, this "J"-shaped leg being configured to extend diagonally from a central portion of an "L"-shaped table such as that shown in FIG. 1A.
Figure 3C:
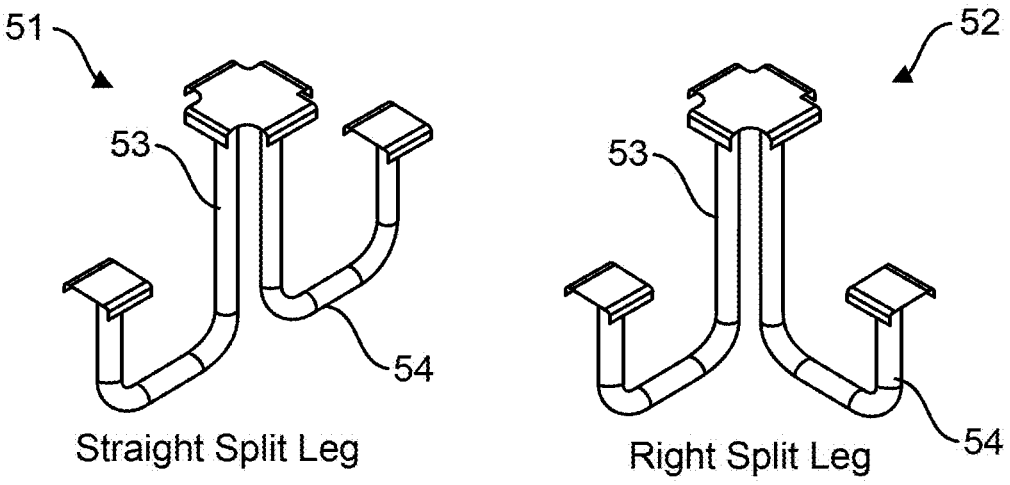
FIG. 3C is a perspective view of a split leg according to an embodiment of the present disclosure.

FIGS. 3A to 3C show samples of modular leg components 40 that can be included in a set of components that is configured and used to assemble modular tables with attached seats, such as those described and shown herein.

FIG. 3A shows first and second embodiments of a "J"-shaped leg 41, 42. Each of the legs 41, 42 includes a first end 43 and a second end 44. At the first end 43 of the leg is a mounting plate 45, which is configured to be affixed to an underside of any of the tabletops 10 included in the set of components. To facilitate attachment to the underside of any of the tabletops 10, in the illustrated embodiments the mounting plate 45 has side flanges 55 positioned along each of its side edges. These side flanges 55 may each include one or more apertures 56, each of which is configured to receive a conventional fastener such as a bolt or the like. In the illustrated embodiment, for example, each side flange 55 includes a pair of apertures 56, with the pair of apertures being equally spaced apart on each of the side flanges. Moreover, as shown in the illustrated embodiment, mounting plate 45 desirably has substantially square-shaped dimensions, with the length and breadth of the plate, e.g. as measured between opposing side flanges 55, being generally the same. This allows the mounting plate 45 to be affixed to the underside of a tabletop 10 in any of four different orientations.

At the second end of the leg is a mounting plate 46, which is configured to be affixed to an underside of any of the seats 30 included in the set of components. As shown in the illustrated embodiments, the mounting plates 45, 46 may be different. In other embodiments, however, mounting plates 45, 46 may be substantially the same or the same.

The main body of each of legs 41, 42 has a first vertical portion 47 that extends downward from the first end 43 (and more particularly from the mounting plate 45 located at the top of the first end), a central portion 48 that extends horizontally and which is configured to rest on a ground surface when a modular table is assembled, and a second vertical portion 49 that extends downward from the second end 44 (and more particularly from the mounting plate 46 located at the top of the second end). As shown in the illustrated embodiment, the central portion 48 may curve up into the first vertical portion 47 at one end may curve up into the second vertical portion 49 at the opposite end. Because the height of the second vertical portion 49 is less than that of the first vertical portion 47, the main body has the general shape of the letter "J".

The difference between leg 41 and leg 42 is that leg 42 extends higher than leg 41. In this way, any of the tabletops 10 included in the set of components can be positioned at one of two different heights. The height of the tabletop 10, which is affixed to mounting plate 45 positioned at the first end 43 of the leg is determined by the height of the first vertical portion 47. The height of the seat 30, which is affixed to the mounting plate 46 positioned at the second end 44 of the leg is determined by the height of the second vertical portion 49. The difference between the height of the first vertical portion 47 and the height of the second vertical portion 49 should be selected to provide a comfortable vertical differentiation between a table and a seat.

For instance, leg 41 may be configured to place a tabletop 10 that is affixed to mounting plate 45 at a height of about thirty inches and a seat 30 that is affixed to mounting plate 46 at a height of about eighteen inches. In contrast, leg 42 may be configured to place a tabletop 10 that is affixed to mounting plate 45 at a height of about forty-two inches and a seat 30 that is affixed to mounting plate 46 at a height of about thirty inches. Although only two different legs 41, 42 are shown, it should be understood that additional legs having different heights may be provided if additional table heights are desired.

FIG. 3B shows an embodiment of a diagonal "J"-shaped leg 43, which has largely the same structure as legs 41, 42 described above (and for which those components are not repeated in detail here). Unlike legs 41, 42, however, leg 43 is configured to extend diagonally from the central portion 12 of an "L"-shaped tabletop 11 so as to place a seat 31 affixed to mounting plate 46 between the inner side edge 16 of the first wing portion 13 and the inner side edge 16 of the second wing portion 14. In order to do so, (a) the mounting plate 45 is rotated about forty-five degrees from that of legs 41, 42 and (b) the central, horizontal portion 48 of leg 43 is longer than that of legs 41, 42. Although the diagonal "J"-shaped leg 43 of only a single height is shown, "J"-shaped legs having two or more different heights may be provided in the same manner as for legs 41, 42 described above.

FIG. 3C shows first and second embodiments of a split leg 51, 52. Each of split legs 51, 52 is configured to provide a tabletop 10 affixed thereto with first and second seats 30. Each of split legs 51, 52 may thus include a first "J"-shaped body 53 and a second "J"-shaped body 54. Each "J"-shaped body comprises a first vertical portion 47, a central portion 48, and a second vertical portion 49, as is described above for legs 41, 42. Moreover, like seats 41, 42, the top end of the second vertical portion 49 of each "J"-shaped body 53, 54 comprises a mounting plate 46 configured to be affixed to the underside of any of the seats 30 included in the set of components. The top end of the first vertical portion 47 also comprises a mounting plate 45 configured to be affixed to the underside of any of the tabletops 10 included in the set of components; however, the first vertical portion 47 of the first "J"-shaped body 53 and the first vertical portion of the second "J"-shaped body 54 share a single mounting plate 45.

In split leg 51, the first and second "J"-shaped bodies 53, 54 extend in opposite directions, and can thus place first and second seats 30 on opposing sides of a rectangular tabletop 18 or on opposing sides of the first or second wing portions 13, 14 of an "L"-shaped tabletop 11 (e.g. with a first seat on the outer side 15 and a second seat on the inner side 16). In split leg 52, the first and second "J"-shaped bodies 53, 54 extend at a ninety-degree angle to one another, and can thus place first and second seats 30 on adjacent sides of a rectangular or square tabletop 18, 19 or in a variety of positions around an "L"-shaped tabletop 11. In particular, a split leg 52 affixed to the central portion 12 of an "L"-shaped tabletop 11 may place first and second seats 30 on each of the two outer sides 15 of the tabletop. A split leg 52 affixed to either the first or second wing portion 13, 14 of an "L"-shaped tabletop may place first and second seats 30 on (a) the outer side 15 and the end edge 17 respectively or (b) the inner side 16 and the end edge 17 respectively.

Although not illustrated, a split leg having three different "J"-shaped bodies is also contemplated (e.g. by combining the "J"-shaped bodies of legs 51, 52). Such a split leg could be affixed to a wing portion 13, 14 of an "L"-shaped tabletop 11 (or an end of a rectangular tabletop 18) in order to provide seats on an outer side 15, an inner side 16, and an end edge 17. Further, although split legs 51, 52 of only a single height are shown, split legs having different heights may be provided in the same manner as for legs 41, 42 described above.

In some embodiments, the central portion 48 of any of the leg components 40 may be configured to be affixed to a ground surface. For instance, the central portion 48 of the leg 40 may comprise one or more apertures, each of which is configured to receive a fastener such as a concrete anchor or the like.

While only a number of embodiments of legs 40 are shown, additional leg configurations (and variations on the illustrated configurations) are contemplated without departing from the scope of the present disclosure.

Figure 4:
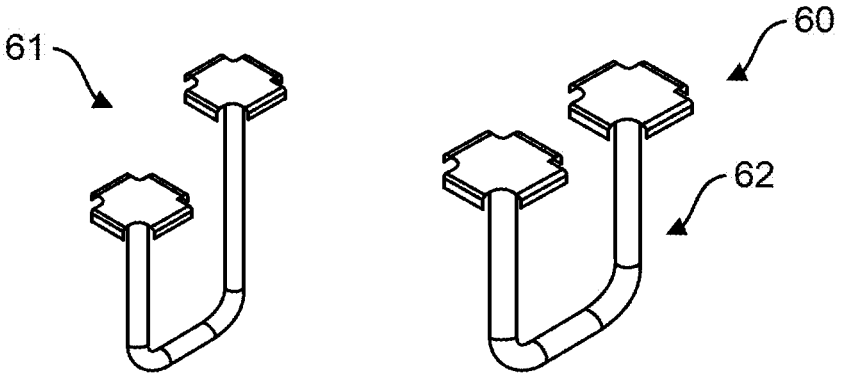
FIG. 4 is a perspective view of table top connectors according to an embodiment of the present disclosure, in particular a "J"-shaped connector and a "U"-shaped connector.

FIG. 4 shows samples of tabletop connectors 60 that can be included in a set of components that is configured and used to assemble modular tables with attached seats, such as those described and shown herein. In particular, FIG. 4 shows a "J"-shaped tabletop connector 61 that is configured to connect together a first tabletop and a second tabletop, with the first and second tabletops being positioned at different heights, and a "U"-shaped tabletop connector 62 that is configured to connect together a first tabletop and a second tabletop, with the first and second tabletops being positioned at the same height.

Each of the tabletop connectors 61, 62 comprises a first end 63 configured to be affixed to an underside of a first tabletop 10 and a second end 64 configured to be affixed to an underside of a second tabletop. At the top of the first end 62 is a mounting plate 65. As illustrated, mounting plate 65 may be identical or substantially identical to the mounting plate 45 that is positioned at the first end of the legs 40 that are included in the set of modular components. At the top of the second end 64 is mounting plate 66. Because mounting plate 66 is also configured to be affixed to the underside of a tabletop 10 as opposed to the underside of a seat 30 (as in legs 40), mounting plate 66 may be identical or substantially identical to mounting plate 65 and the mounting plate 45 of the legs 40.

Each connector 61, 62 comprises a "J"-shaped or "U"-shaped main body which includes a first vertical portion 67 that extends downward from the first end 63 (and more particularly from the mounting plate 65 located at the top of the first end), a central portion 68 that extends horizontally and which is configured to rest on a ground surface when a modular table is assembled, and a second vertical portion 69 that extends downward from the second end 64 (and more particularly from the mounting plate 66 located at the top of the second end). As shown in the illustrated embodiment, the central portion 68 may curve up into the first vertical portion 67 at one end may curve up into the second vertical portion 69 at the opposite end.

For connector 61, because the height of the second vertical portion 69 is less than that of the first vertical portion 67, the main body has the general shape of the letter "J". For connector 62, because the height of the second vertical portion 69 is the same as that of the first vertical portion 67, the main body has the general shape of the letter "U". Because the central portion 68 of each connector 61, 62 rests on a ground surface, in addition to securing together two tabletop components 10, the connectors also provide support for the tabletop components, e.g. in addition to the one or more legs 40 that may also be affixed to one or both of the tabletop components.

In some embodiments, the central portion 68 of any of the connectors 60 may be configured to be affixed to a ground surface. For instance, the central portion 68 of the connector 60 may comprise one or more apertures, each of which is configured to receive a fastener such as a concrete anchor or the like.

Although embodiments of tabletop connectors 61, 62 of only a single height are shown, tabletop connectors having different heights may be provided in the same manner as for legs 41, 42 described above. Moreover, although only two different embodiments of tabletop connectors 60 are illustrated, additional connector configurations (and variations on the illustrated configurations) are contemplated without departing from the scope of the present disclosure.

Figure 5A:
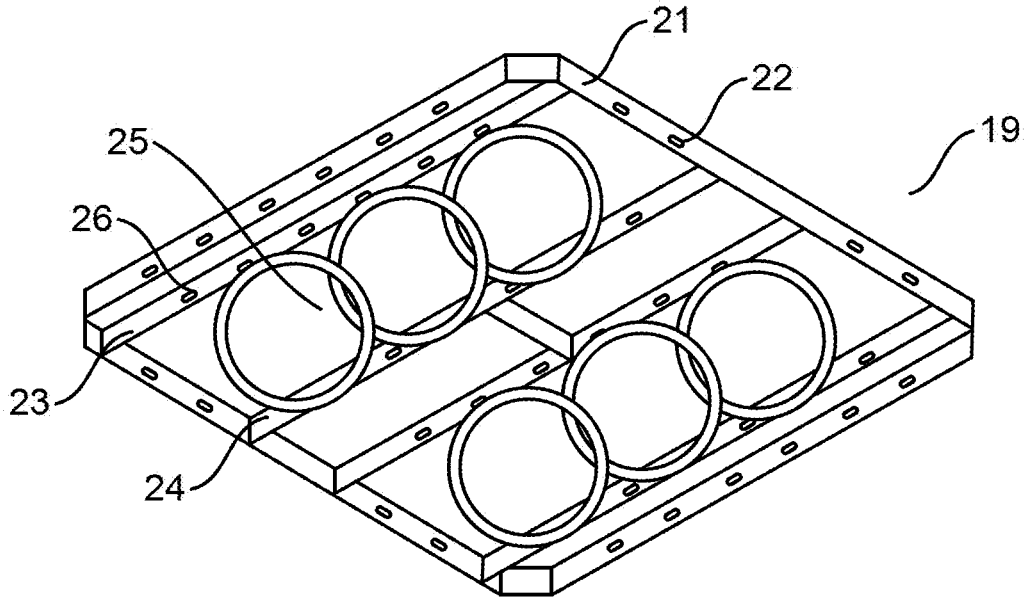
FIG. 5A is a bottom perspective view of a square tabletop according to an embodiment of the present disclosure, showing a plurality of locations where a mounting plate of a leg or a mounting plate of a table top connector can be affixed.
Figure 5B:
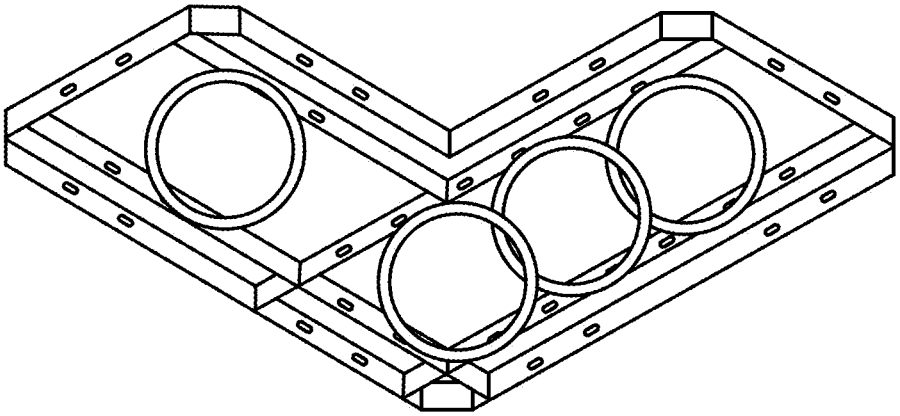
FIG. 5B is a bottom perspective view of an "L"-shaped tabletop according to an embodiment of the present disclosure, showing a plurality of locations where a mounting plate of a leg or a mounting plate of a table top connector can be affixed.

FIGS. 5A and 5B show the underside of the embodiments of square tabletop 19 and "L"-shaped tabletop 11 components illustrated in FIGS. 1C and 1A respectively. The underside of each tabletop includes at least a first rail 23 and a second rail 24, the first and second rails running parallel to one another and being spaced apart by a defined distance. The defined distance between the first and second rails 23, 24 is slightly larger than the length and breadth dimensions of mounting plate 45, mounting plate 65, and/or mounting plate 66, such that the mounting plates of any of the legs and/or connector components included in the set of modular components can be received in between the first and second rails with the side flanges 55 of the mounting plate being in close proximity or even in contact with the inner surfaces of the rails.

Each of the first and second rails 23, 24 includes one or more, and desirably a plurality of apertures 26. In order to affix the mounting plate 45, 65, 66 of any of the legs and/or connectors 60 to the underside of the tabletop 10, the one or more apertures 56 on opposing side flanges 55 of the mounting plate can be aligned with one or more apertures 26 of the first and second rails 23, 24 and fasteners, e.g. bolts or the like, passed through the apertures and tightened. Accordingly, the distance between some of the plurality of apertures 26, e.g. adjacent apertures in the illustrated embodiment, on each of the first and second rails 23, 24 may be substantially equivalent to the distance between the apertures located on each side flange 55 of mounting plates 45, 65, 66, such that each side flange can be secured to one of the first and second rails by multiple, e.g. two, fasteners.

The first and second rails 23, 24 may include a plurality of apertures 26 along a length thereof, thereby providing a plurality of different connection points for a mounting plate of a leg 40 or connector. In some embodiments, for instance, the first and second rails 23, 24 may span an entire dimension of the tabletop 10, thereby providing the maximum number of connection points between a mounting plate of a leg 40 or connector 60 and the tabletop.

In the square tabletop 19 shown in FIG. 5A, each of rails 23, 24 spans between opposing side flanges 21 of the tabletop and includes apertures 26 spanning along the entire length. The rails 23, 24 thereby define a plurality of attachment points 25 (indicated by circles) where a mounting plate 45, 65, 66 of a leg 40 or connector 60 from the set of modular components could be attached. This allows a designer to create a variety of different table and seat combinations from the modular set of components.

Any of the tabletops 10 may also include more than one set of rails 23, 24. For instance, the square tabletop 19 shown in FIG. 5A has a first set of rails 23, 24 positioned along a first side of the tabletop and a second set of rails positioned along a second side of the tabletop. This provides attachment points 25 at various positions along each of the first and second sides of the tabletop. Moreover, for the attachments points 25 located at the corners of the tabletop 19, depending on the orientation that the leg 40 or connector 60 is provided with when inserted between the first and second rails 23, 24, the second end of the leg or connector may extend on either the side of the tabletop that is parallel with the rails (e.g. the first or second side of the tabletop) or on the adjacent side (e.g. the third or fourth side) of the tabletop. Alternatively, the right angle split leg 52 can be connected to a corner attachment point 25 to provide seats on each of two adjacent sides (e.g. the first and third side) of the tabletop.

The "L"-shaped tabletop 11 shown in FIG. 5B comprises a first set of rails 23, 24 spanning the central portion 12 and the first wing portion 13, which defines three attachment points 25 (two on the first wing and one on the central portion), and a second set of rails on the second wing portion 14 that defines another attachment point. In an alternative embodiment, the second set of rails may define two attachment points 25 on the second, e.g. in the same manner that the first set of rails defines two attachment points on the first wing. Although the underside of the rectangular tabletop 18 of FIG. 1B is not shown, in some embodiments it may have a set of rails 23, 24 that is substantially identical to the first set of rails provided on the "L"-shaped tabletop 11 and shown in FIG. 5B as defining three attachment points 25.

As with the rectangular tabletop 19 described above, the plurality of attachment points 25 provides a huge variety of options for legs 40 and/or connectors 60. For the attachment points 25 located on either the first wing portion 13 or the second wing portion 14 for instance, a leg such as legs 41, 42 shown in FIG. 3A, or a connector, such as those shown in FIG. 4 can be attached to extend to the outer side 15 of the table, to the inner side 16 of the table, or even to the end 17 of the wing depending on the orientation of the leg or connector when inserted between the first and second rails 23, 24. Alternatively, a straight split leg 51 such as that shown in FIG. 3C can be connected to an attachment point 25 located on either the first wing portion 13 or the second wing portion 14 to provide seats on both the outer side 15 of the tabletop and the inner side 16 of the tabletop. Or a right angle split leg 52 such as that shown in FIG. 3C can be connected to an attachment point 25 located on either the first wing portion 13 or the second wing portion 14 to provide a first seat located on either the outer side 15 of the tabletop or the inner side 16 of the tabletop (depending on the orientation of the split leg when inserted between the first and second rails 23, 24) and a second seat located on the end 17 of the tabletop.

For the attachment point 25 located on the central portion 12, a leg such as legs 41, 42 shown in FIG. 3A, or a connector, such as those shown in FIG. 4 can be attached to extend to the outer side 15 of the table that extends into the first wing portion 13 or to the outer side of the table that extends into the second wing portion 14 depending on the orientation of the leg or connector when inserted between the first and second rails 23, 24. Or a right angle split leg 52 such as that shown in FIG. 3C can be connected to the attachment point 25 to provide a first seat located on the outer side 15 of the table that extends into the first wing portion 13 and a second seat located on the outer side of the table that extends into the second wing portion 14. Alternatively, a leg such as the diagonal leg 43 shown in FIG. 3B can be attached to extend diagonally into the space between the inner sides 16 of the first and second wing portions 13, 14.

By providing a modular set of components that includes one or more and desirably a plurality of tabletops 10, such as any one or more of those shown in FIGS. 1A to 1C (and FIGS. 5A to 5B); one or more and desirably a plurality of seats 30, such as any one or more of those shown in FIGS. 2A to 2B; one or more and desirably a plurality of legs 40, such as any one or more of those shown in FIGS. 3A to 3C; and optionally one or more and desirably a plurality of connectors 60, such as any one or more of those shown in FIG. 4, a set of components can be provided that gives one the ability to assemble a huge variety of different unique tables and seating arrangements using the same set of modular components.

FIGS. 6A to 16C show examples of unique tables 100 that can be assembled with the modular components shown in FIGS. 1A to 5B.

Figure 6A:
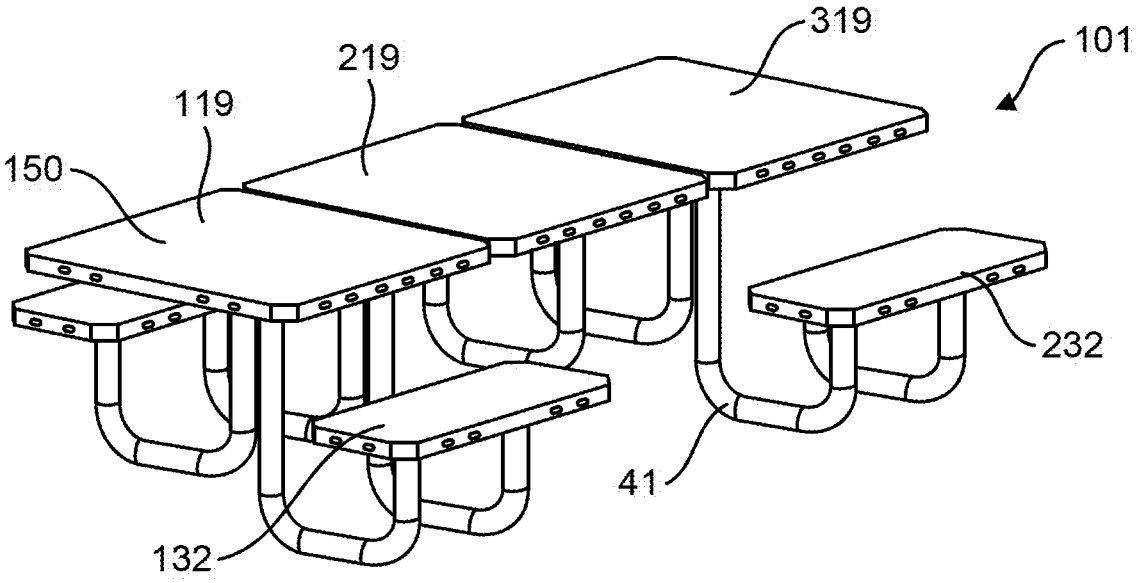
FIG. 6A is a perspective view of an embodiment of a modular picnic table in accordance with an embodiment of the present disclosure.
Figure 6B:
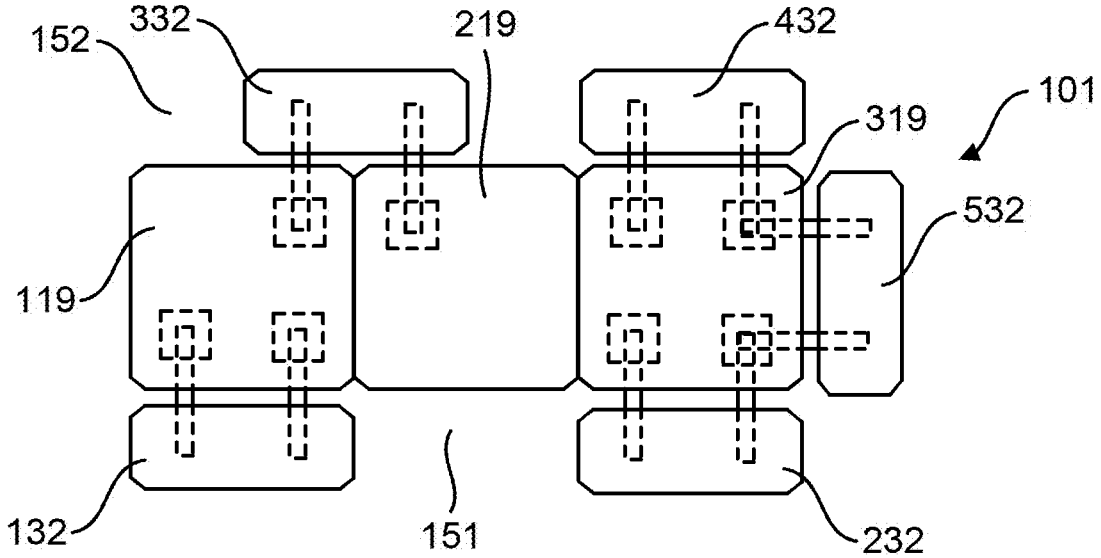
FIG. 6B is a top plan view of the embodiment of a modular picnic table shown in FIG. 6A, showing the connections of the legs.
Figure 6C:
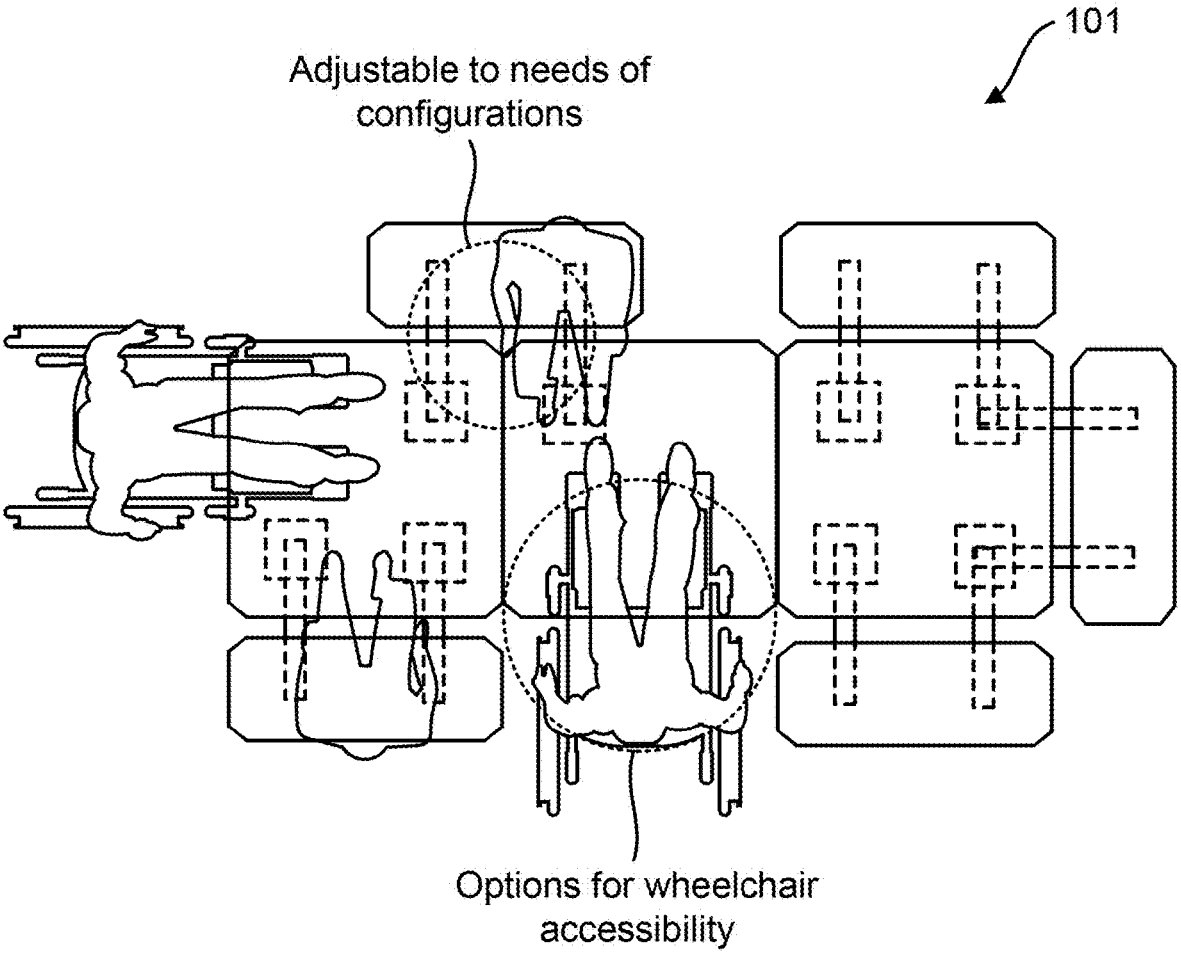
FIG. 6C is a top plan view of the embodiment of a modular picnic table shown in FIG. 6A, showing potential seating locations and wheelchair accessibility points.

A first embodiment of a table, table 101 is shown in FIGS. 6A to 6C. Table 101 comprises a plurality of square tabletop components 19, which may be secured to one another by their side flanges 21 as described herein to produce a substantially continuous table surface 150 having a rectangular shape that resembles a conventional picnic table. Table 101 also comprises a plurality of bench seats 32 positioned along the first side of the table surface 150 and a plurality of bench seats positioned along the second side of the table surface. Each bench seat 32 is attached to one, or in one case two, of the square tabletop components 19 by first and second "J"-shaped legs 41.

In contrast to a conventional picnic table, however, the bench seats on the first and second sides of the table surface 150 are not continuous. Rather, the first side of the table surface 150 includes a first bench seat 132 attached to a first tabletop component 119 and a second bench seat 232 attached to a third tabletop component 319 but no seat attached to the second tabletop component, thereby creating a space 151 between the first and second bench seats 132, 232. As shown in FIG. 6C, space 151 may be configured so that a person in a wheelchair can comfortably utilize the table without encountering any obstructions under the second tabletop surface 219.

Similarly, the second side of the table surface 150 includes a third bench seat 332 and a fourth bench seat 432. Whereas the fourth bench seat 432 is affixed to the third tabletop component 319 however, the third bench seat 332 has a first leg 41 affixed to the first tabletop component 119 and a second leg affixed to the second tabletop component 219. This too creates a space between bench seats 332, 432, but one that is smaller than space 151 (and thus not configured for use by a person in a wheelchair) but which may provide ease of access into the two bench seats. Moreover, by moving bench seat 332 away from the first end of the table surface 150, an additional unobstructed space 152 at the first end of the table surface is created. As shown in FIG. 6C, space 152 may also be configured for a person in a wheelchair to comfortably utilize the table without encountering any obstructions under the first tabletop surface 119. The second end of the table surface 150 (i.e. the outer end of the third tabletop component 319) has a fifth bench seat 532 attached to provide additional seating options.

As could easily be envisioned from FIGS. 6A to 6C, table 101 could easily be altered to provide a different desired seating arrangement, e.g. by adding or removing one or more bench seats, by shifting one or more of the bench seats to a different location, by adding or removing one or more square tabletop components, etc., to produce any number of unique tables, all using a set of modular components that included only a plurality of square tabletop components 19, bench seats 32, and "J"-shaped legs 41. The number of different unique tables that could be created using a set of modular components that included additional components, e.g. one or more additional tabletop components 10, one or more additional seats 30, one or more additional leg components 40, and/or one or more connectors 60, is almost limitless.

Figure 7A:
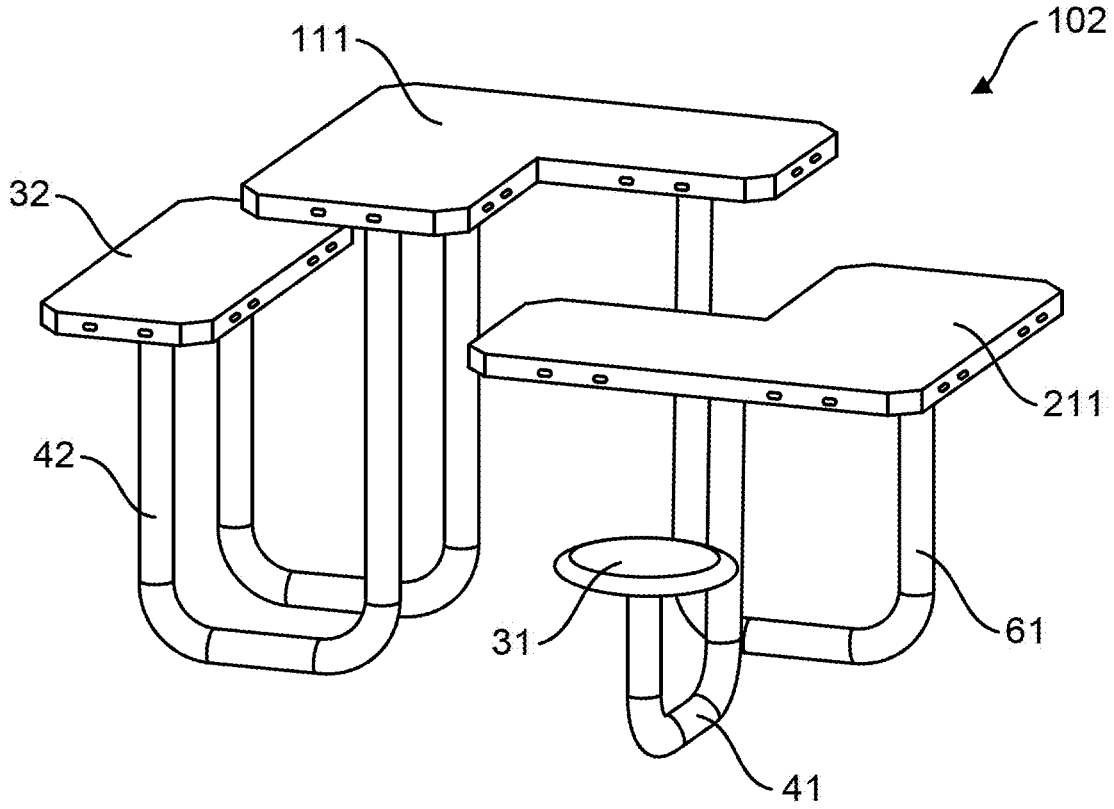
FIG. 7A is a perspective view of an embodiment of a modular multi-level table in accordance with an embodiment of the present disclosure.
Figure 7B:
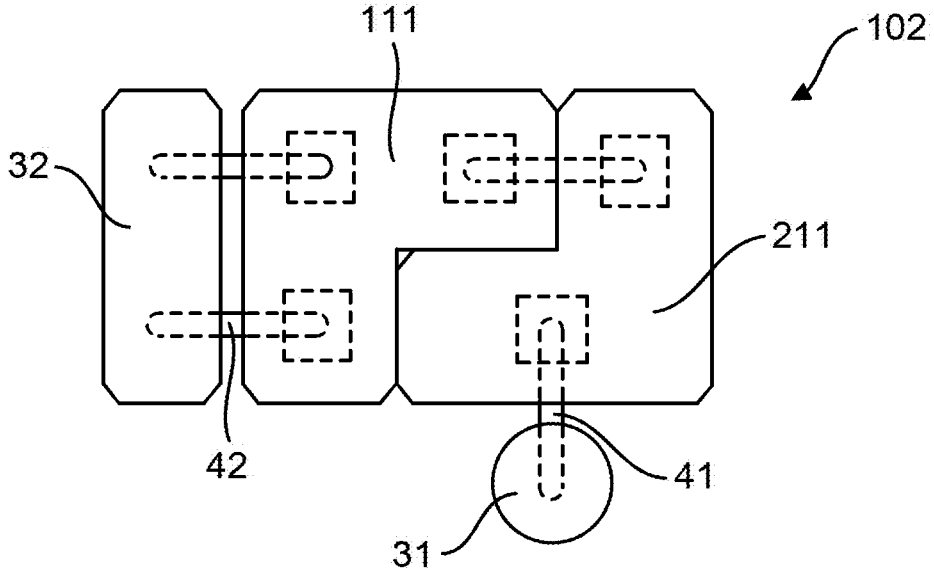
FIG. 7B is a top plan view of the embodiment of a modular multi-level table shown in FIG. 7A, showing the connections of the legs and the table top connector.
Figure 7C:
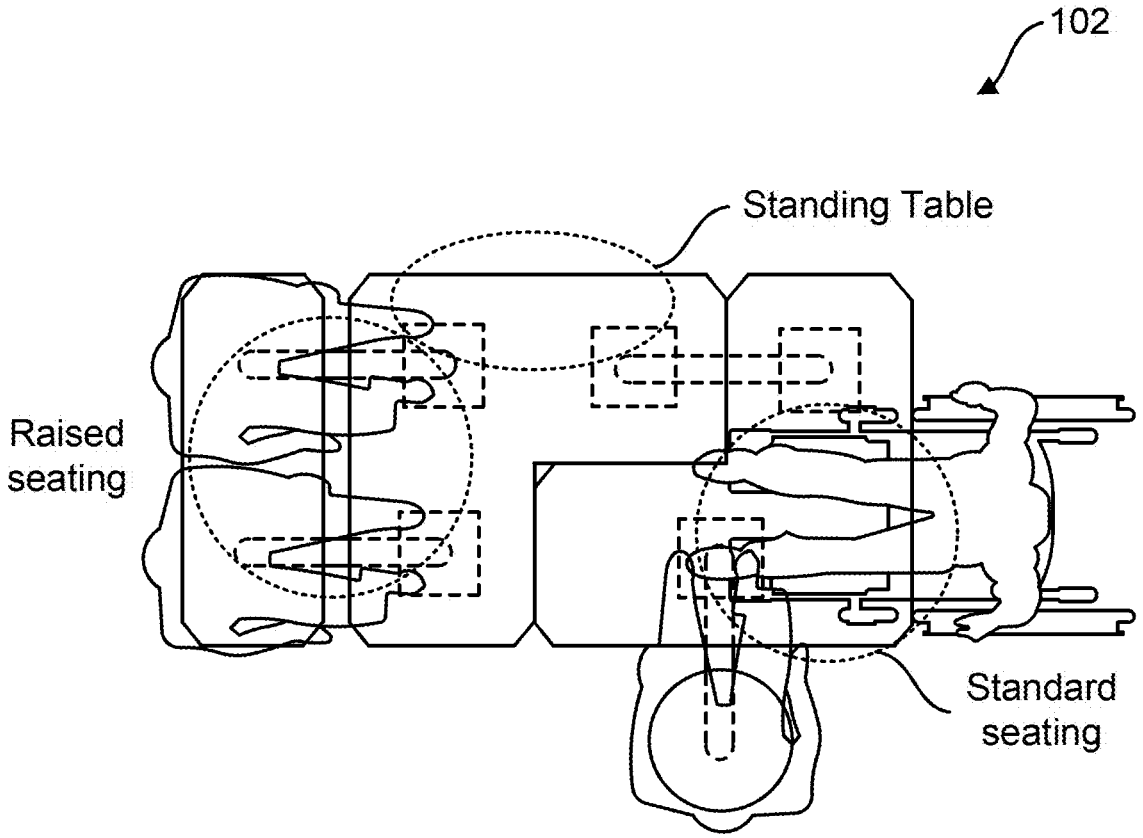
FIG. 7C is a top plan view of the embodiment of a modular multi-level table shown in FIG. 7A, showing potential seating locations and wheelchair accessibility points.

A second embodiment of a table, table 102 is shown in FIGS. 7A to 7C. Table 102 comprises a "L"-shaped tabletop components 11, a single-occupancy seat 31, a bench seat 32, a first "J"-shaped leg 41 (having a first height), second "J"-shaped legs 42 (having a second height), and a "J"-shaped connector 61. More particularly, table 102 comprises a first "L"-shaped tabletop component 111 and a second "L"-shaped tabletop component 211. The first tabletop component 111 is provided at a first height, e.g. a height of about forty-two inches. The second tabletop component 211 is provided at a second height, e.g. a height of about thirty inches. The first and second tabletop components 111, 211 are oriented with the inner side edges 16 of each facing one another, such that when viewed from above the tabletop components together form a rectangular shape (as can be seen in FIG. 7B). The first and second tabletop components 111, 211 are attached together by a "J"-shaped connector element 61 having its first (higher) end affixed to an underside of the first tabletop component and its second (lower) end affixed to an underside of the second tabletop component.

The first tabletop component 111 is provided with a bench seat 32 at its outer side edge 15. The bench seat 32 is attached to the first tabletop component 111 by first and second "J"-shaped legs 42 that are configured for use with higher tables. In the illustrated embodiment, the other outer side edge 15 is kept free of seats. Given the height of the first tabletop component 111, that free side of the tabletop can be utilized as a standing table, e.g. as shown in FIG. 7C.

The second tabletop component 211 is provided with a single-occupancy seat 31 at an outer side edge 15, and more particularly the central attachment point 25 of the three shown in a row on the underside of an "L"-shaped tabletop component in FIG. 5B (positioned on the first wing portion 13 but adjacent to the central portion 12). The seat 31 is attached to the second tabletop component 211 by a single "J"-shaped leg 41 that is configured for use with lower tables. By positioning the seat 31 attachment point at the first wing portion 13 instead of at the central portion 12 of the "L"-shaped tabletop component 211, the other outer side edge 15 of the tabletop component is kept free of obstructions such that it can be comfortably utilized by a person in a wheelchair without encountering any obstructions under the tabletop component, as is illustrated in FIG. 7C.

By providing a table that includes tabletop surfaces 111, 211 at two different heights and a variety of usage options (e.g. single occupancy seat 31, multiple occupancy bench seat 32, side of higher tabletop 111 serving as a standing table, and side of lower tabletop 211 being accessible by a person in a wheelchair), table 102 provides a highly unique table that provides improved usage options for people having different needs. Table 102 also provides user experiences that differ significantly from those provided by conventional picnic tables.

Although a particular design is shown in the illustrated embodiment, as could easily be envisioned from FIGS. 7A to 7C, table 102 could be altered to provide a different desired seating arrangement, e.g. by adding or removing one or more seats 31, 32; by shifting one or more of the seats 31, 32 to a different location, by adding or removing one or more additional tabletop components 10, etc., to produce any number of unique tables.

Figure 8A:
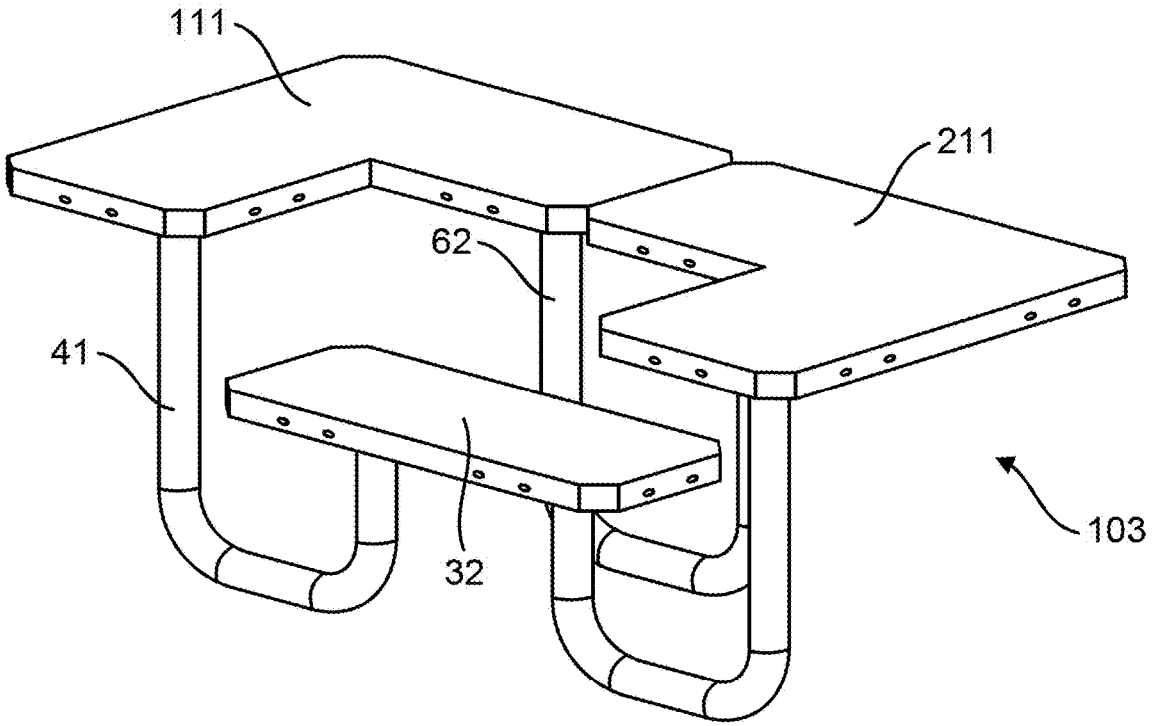
FIG. 8A is a perspective view of an embodiment of a modular table in accordance with an embodiment of the present disclosure.
Figure 8B:
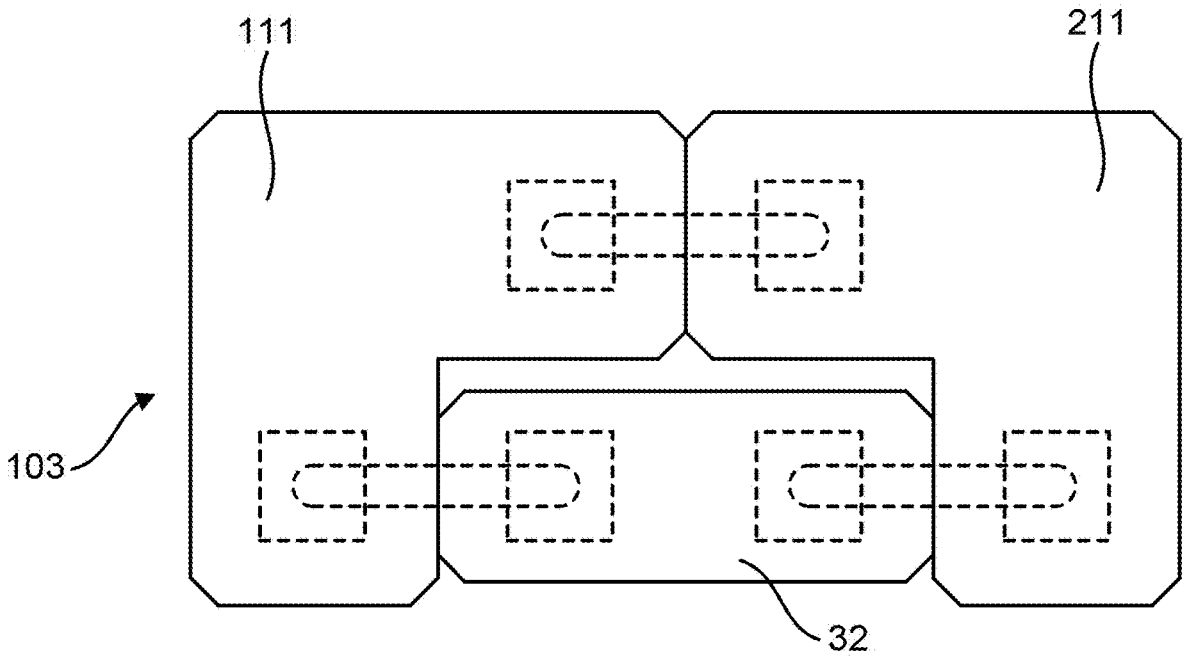
FIG. 8B is a top plan view of the embodiment of a modular table shown in FIG. 8A, showing the connections of the legs and the table top connector.
Figure 8C:
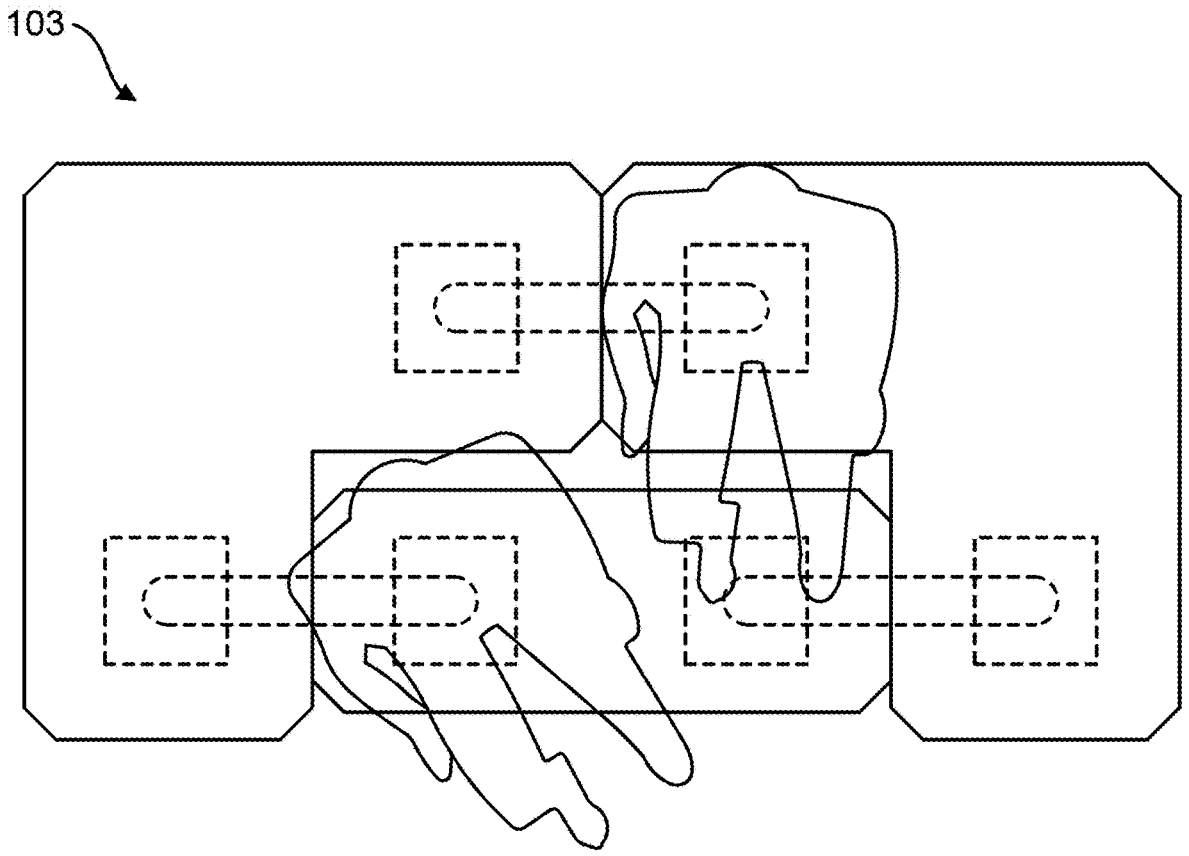
FIG. 8C is a top plan view of the embodiment of a modular table shown in FIG. 8A, showing potential seating locations.

A third embodiment of a table, table 103 is shown in FIGS. 8A to 8C. Table 103 comprises "L"-shaped tabletop components 11, a bench seat 32, legs 41, and a "U"-shaped connector 62. More particularly, table 103 includes first and second "L"-shaped tabletop components 111, 211 affixed together via the side flanges 21 positioned at an outer end edge 17 of each tabletop. Bench seat 32 is positioned in the space formed by the inner side edges 16 of each of the first and second tabletop components 111, 211. Specifically, a first leg 41 extends from a wing portion of the first "L"-shaped tabletop component (the wing portion whose end edge 17 remains free) and a second leg extends from a wing portion of the second "L"-shaped tabletop component 211 (also the wing portion whose end edge 17 remains free). The result is a multi-level lounge table that provides seating options both on the provided bench seat 32 and on the tabletop components 111, 211, e.g. as is shown in FIG. 8C. Seating options for a person in a wheelchair are also provided at the central portion of each of the "L"-shaped tabletop components 111, 211.

Figure 9A:
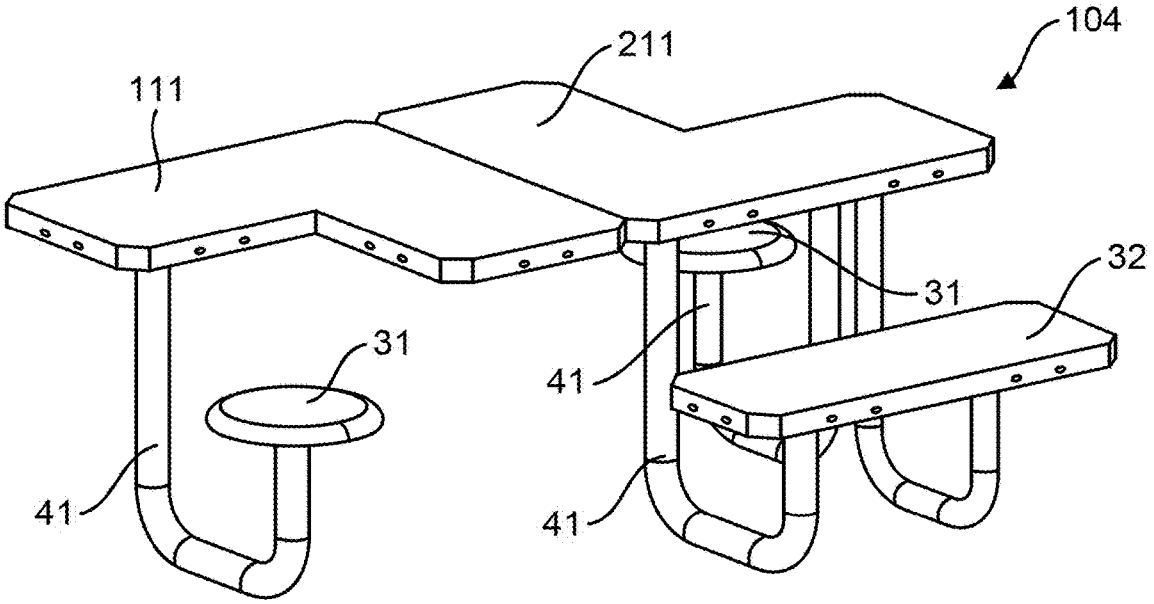
FIG. 9A is a perspective view of an embodiment of a modular table in accordance with an embodiment of the present disclosure.
Figure 9B:
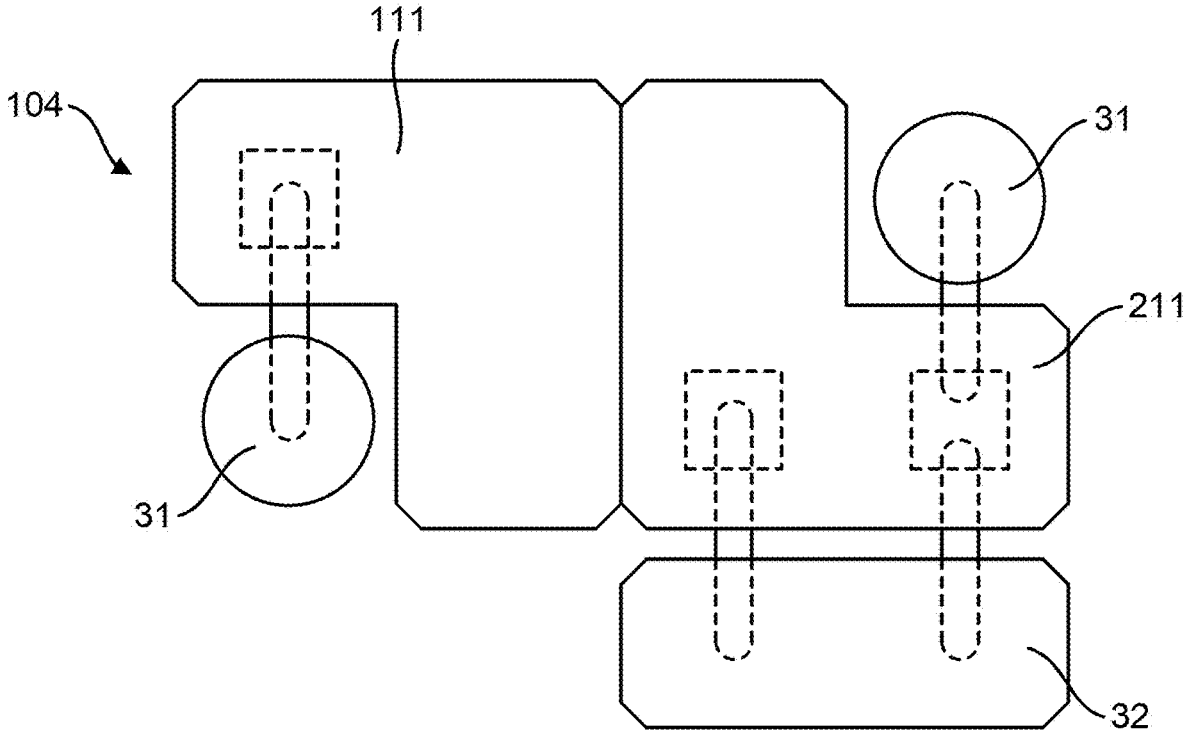
FIG. 9B is a top plan view of the embodiment of a modular table shown in FIG. 9A, showing the connections of the legs.
Figure 9C:
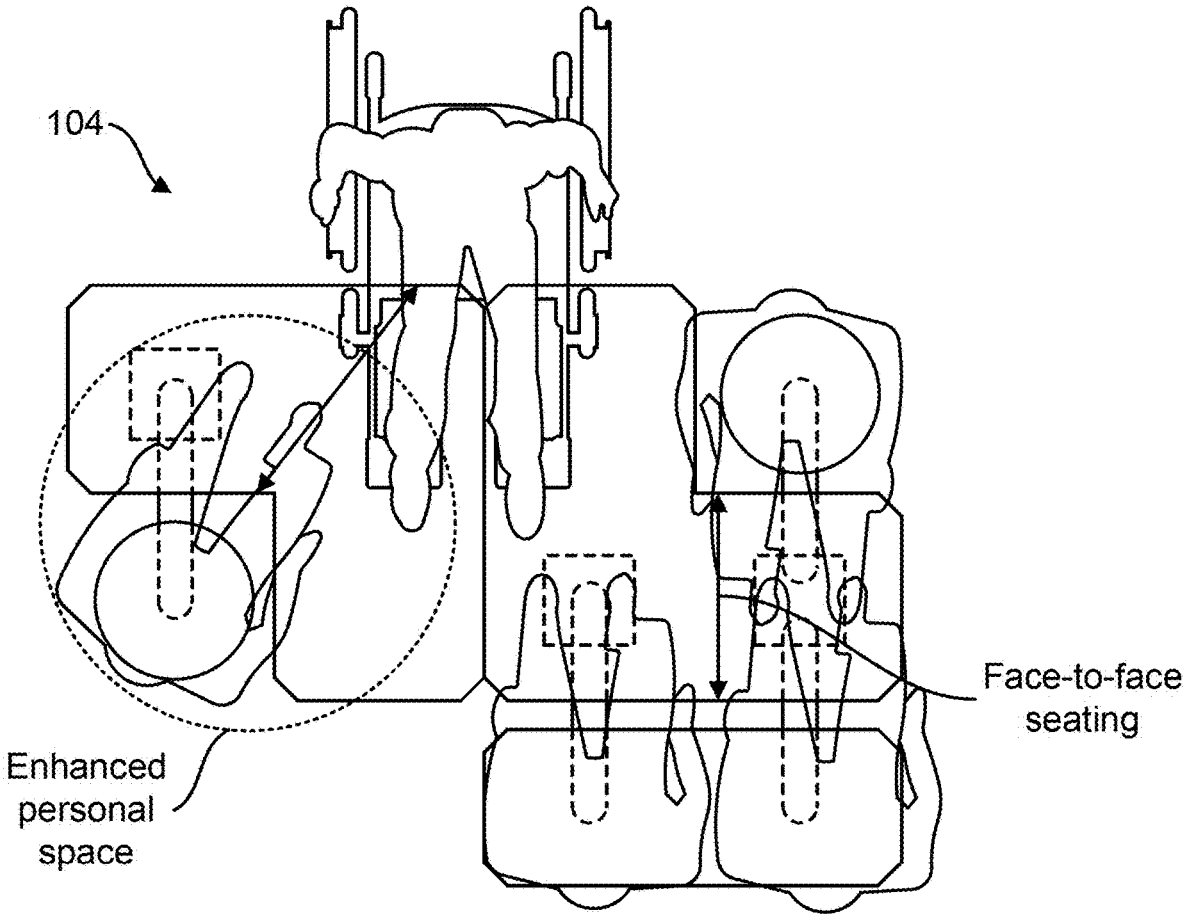
FIG. 9C is a top plan view of the embodiment of a modular table shown in FIG. 9A, showing potential seating locations and wheelchair accessibility points.

A fourth embodiment of a table, table 104 is shown in FIGS. 9A to 9C. Table 104 comprises "L"-shaped tabletop components 11, single-occupancy seats 31, a bench seat 32, and legs 41. More particularly, table 104 includes first and second "L"-shaped tabletop components 111, 211 that are affixed to one another via the side flanges 21 positioned on an outer side edge 15 of each tabletop component. Each tabletop component 111, 211 is provided with a single-occupancy seat 31 positioned in the space formed by the inner side edges 16 of the first and second wing portions. Each of the seats 31 is affixed to an underside of the tabletop component 111, 211 by a "J"-shaped leg 41. Moreover, the second "L"-shaped tabletop component 211 is provided with a bench seat 32 on the outer side edge 15 that is not attached to the first "L"-shaped tabletop component 111. The bench seat 32 is affixed to an underside of the tabletop component 211 by first and second "J"-shaped legs 41.

Table 104 provides a variety of different seating options, including one-to-one and one-to-two seating options (at tabletop component 211), seating options with enhanced personal space and/or distancing (at seats 31), and wheelchair accessible seating options (at the space formed at the top of the combined tabletop as shown in FIG. 9C). Moreover, all of the seating options (with the potential exception of the wheelchair access space) are accessible even when any side of the table 104 is aligned with a wall.

Figure 10A:
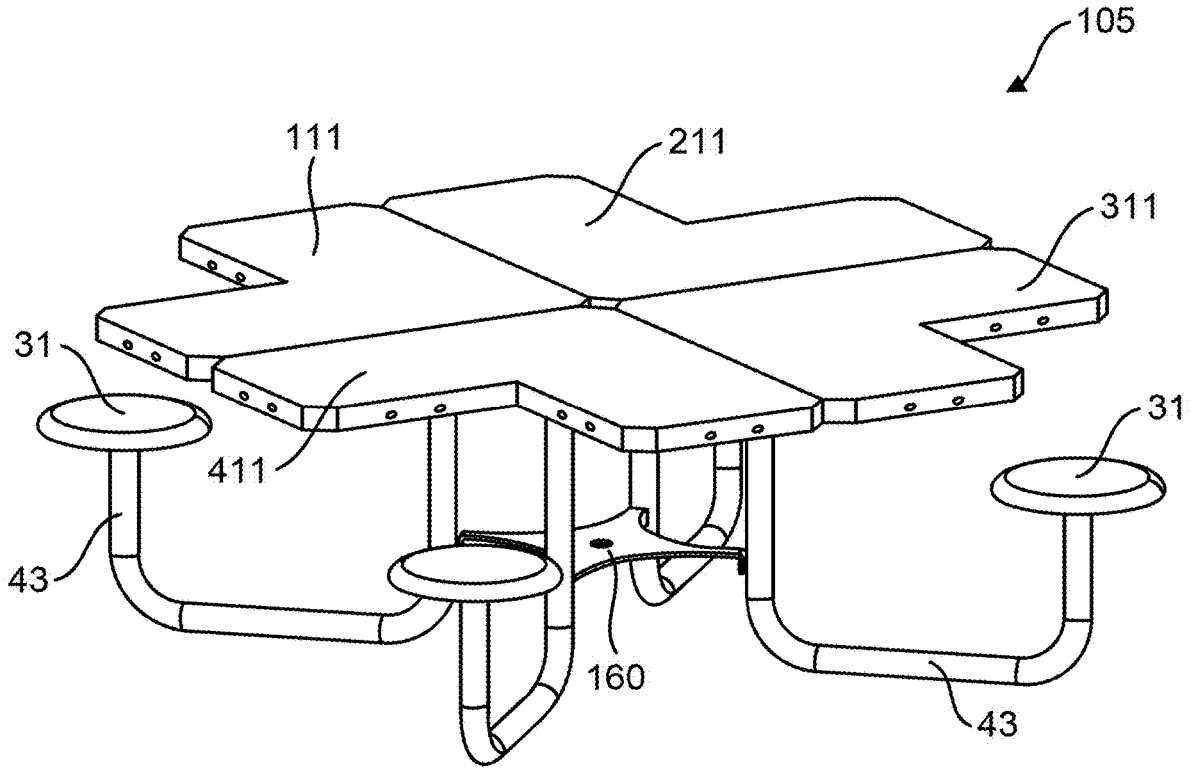
FIG. 10A is a perspective view of an embodiment of a modular table in accordance with an embodiment of the present disclosure.
Figure 10B:
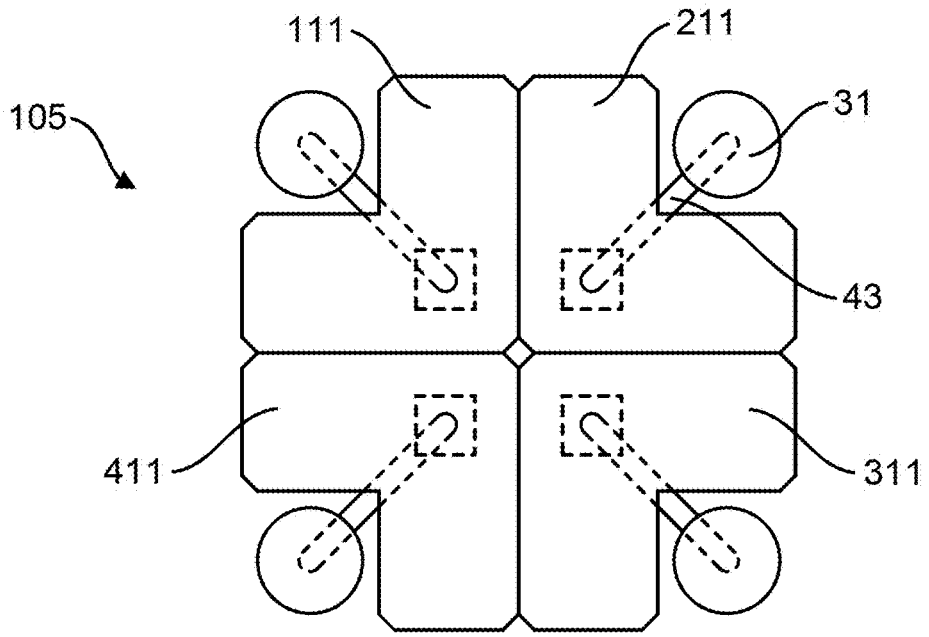
FIG. 10B is a top plan view of the embodiment of a modular table shown in FIG. 10A, showing the connections of the legs.
Figure 10C:
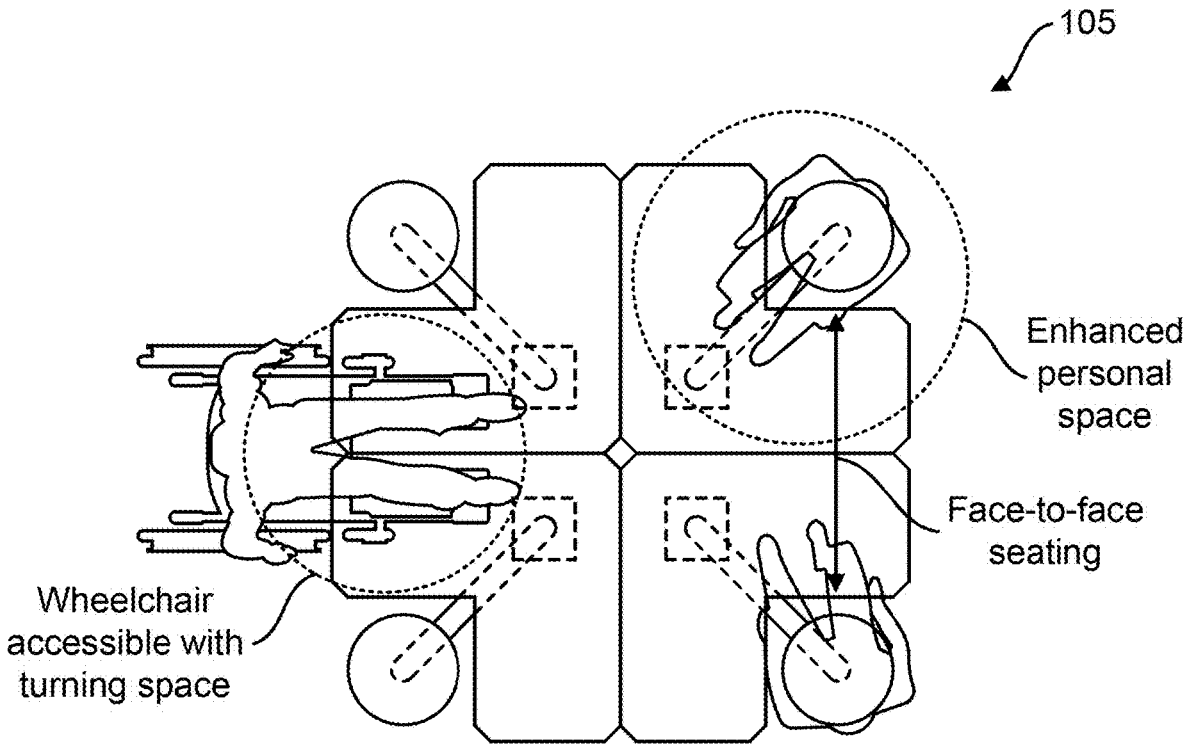
FIG. 10C is a top plan view of the embodiment of a modular table shown in FIG. 10A, showing potential seating locations and wheelchair accessibility points.

A fifth embodiment of a table, table 105 is shown in FIGS. 10A to 10C. Table 105 comprises "L"-shaped tabletop components 11, single-occupancy seats 31, and diagonal legs 43 such as those shown in FIG. 3B. More particularly, table 105 comprises four "L"-shaped tabletop elements 111, 211, 311, 411 connected together with the central portion 12 of each tabletop element positioned at the center of the resulting table surface 150. Each outer edge 15 of each "L"-shaped tabletop element is attached to the outer edge of an adjacent "L"-shaped tabletop element via the adjacent side flanges 21. A single-occupancy seat 31 is provided in the space formed by the inner side edges 16 of the first and second wing portions 13, 14 of each "L"-shaped tabletop 111, 211, 311, 411. Each seat 31 is attached to the central portion 12 of the "L"-shaped tabletop by a diagonal leg component 43. Additionally, Table 105 may be provided with an additional brace element 160, which can be affixed to each of legs 43 and which can be used to provide a table such as table 105 with improved stability.

Table 105 provides a plurality of seating options, each of which provides a high level of personal space while allowing for face-to-face conversation between at least four people. Table 105 also provides a plurality of wheelchair accessible seating locations at the free outer edges 17 of each of the tabletop components 111, 211, 311, 411, as shown in FIG. 10C.

Figure 11A:
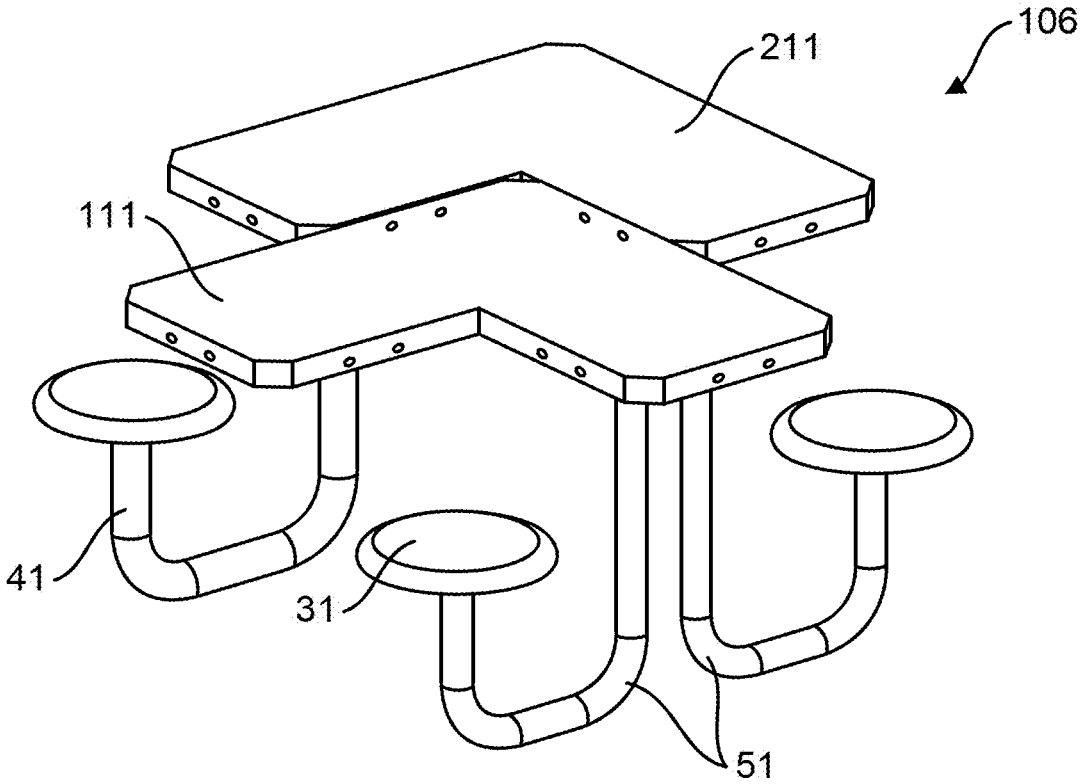
FIG. 11A is a perspective view of an embodiment of a modular table in accordance with an embodiment of the present disclosure.
Figure 11B:
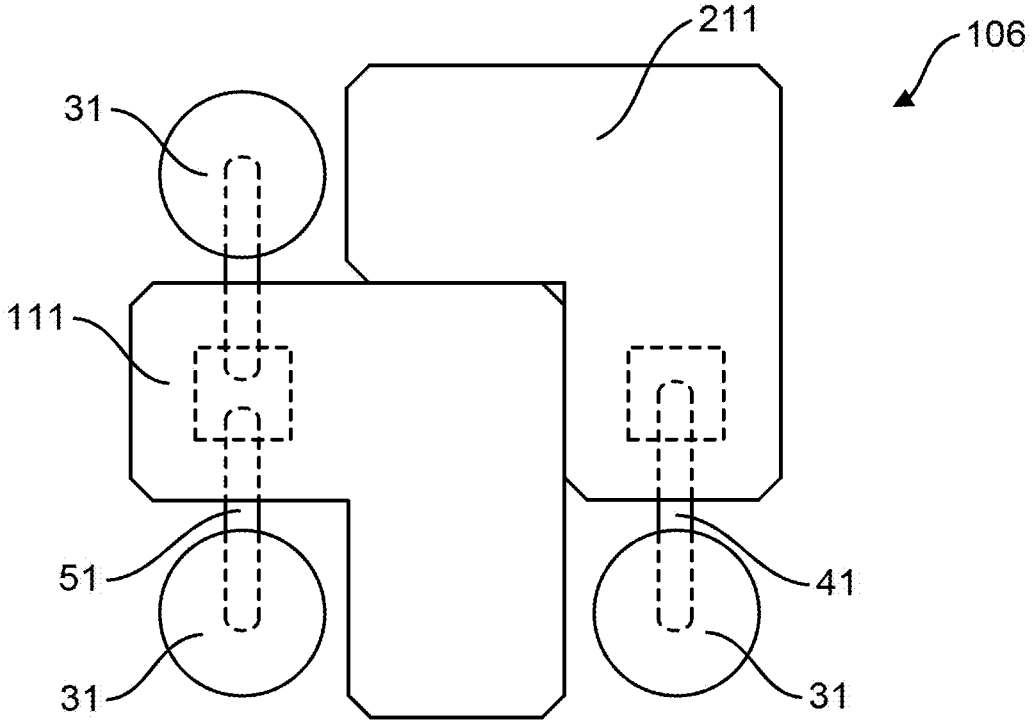
FIG. 11B is a top plan view of the embodiment of a modular table shown in FIG. 11A, showing the connections of the legs.
Figure 11C:
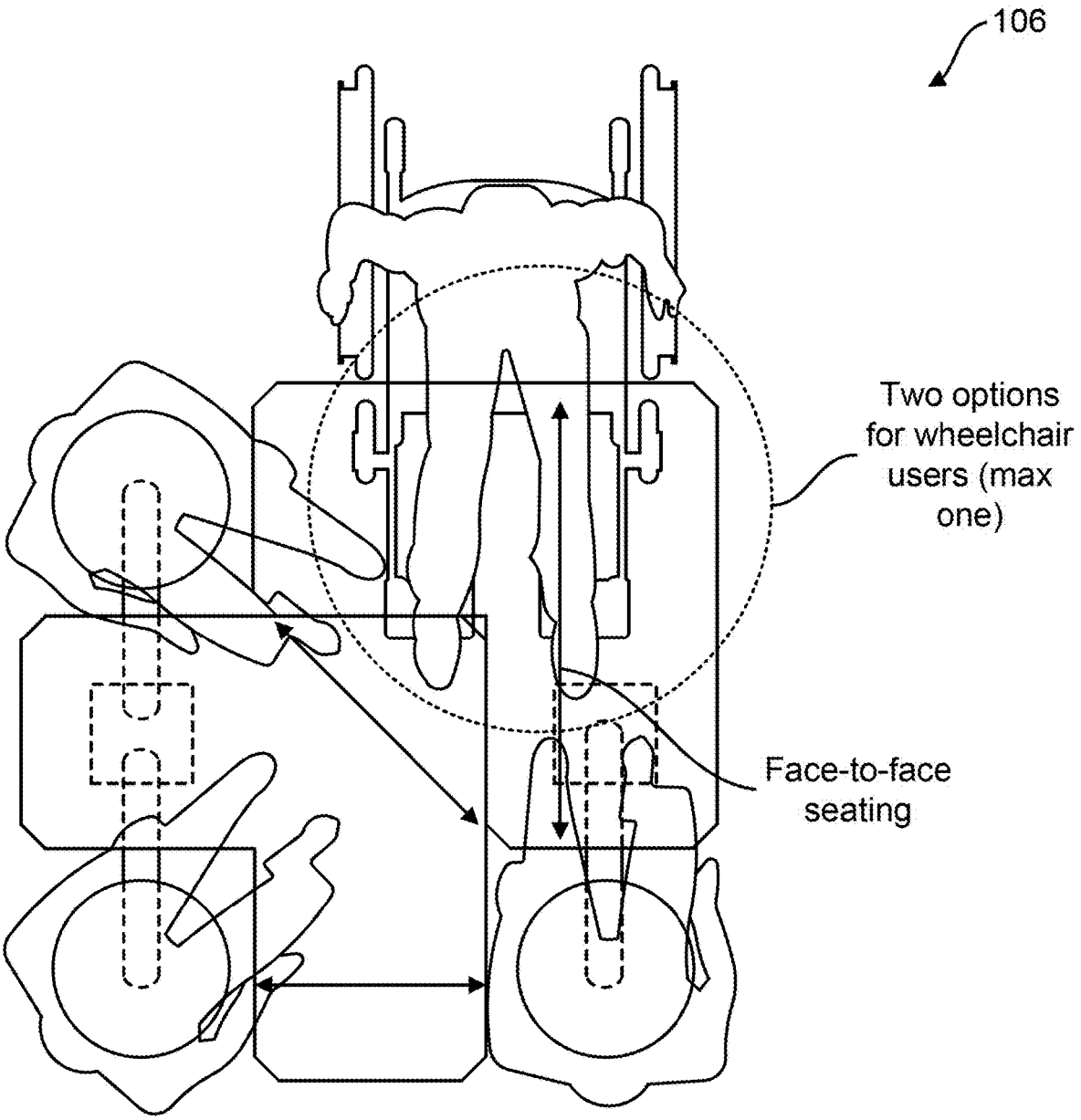
FIG. 11C is a top plan view of the embodiment of a modular table shown in FIG. 11A, showing potential seating locations and wheelchair accessibility points.

A sixth embodiment of a table, table 106 is shown in FIGS. 11A to 11C. Table 106 comprises "L"-shaped tabletop components 11, single-occupancy seats 31, a "J"-shaped leg 41, and a straight split leg 51 such as that shown in FIG. 3C. More particularly, table 106 includes first and second "L"-shaped tabletop components 111, 211, the center portion 12 of the first tabletop component being positioned in the space formed by the interior side edges 16 of the second tabletop component and the two tabletop components being attached via the side flanges 21. First and second single-occupancy seats 31 are attached to a wing portion of the first tabletop component 111 by a straight split leg 51, with a first seat being positioned at the inner side edge 16 of the wing portion and a second seat being positioned on the outer side edge 15 of the wing portion. A third single-occupancy seat 31 is attached to a wing portion of the second tabletop component 211, e.g. using a "J"-shaped leg 41, and is positioned at the end edge 17 of tabletop component 211.

Table 106 provides a seating arrangement that is similar to table 105 (but on a smaller scale), with a plurality of seating options, each of which provides a high level of personal space while allowing for face-to-face conversation between all occupants. Table 106 also provides a wheelchair accessible seating location at the outer edge 15 of tabletop components 211, as shown in FIG. 11C.

Figure 12A:
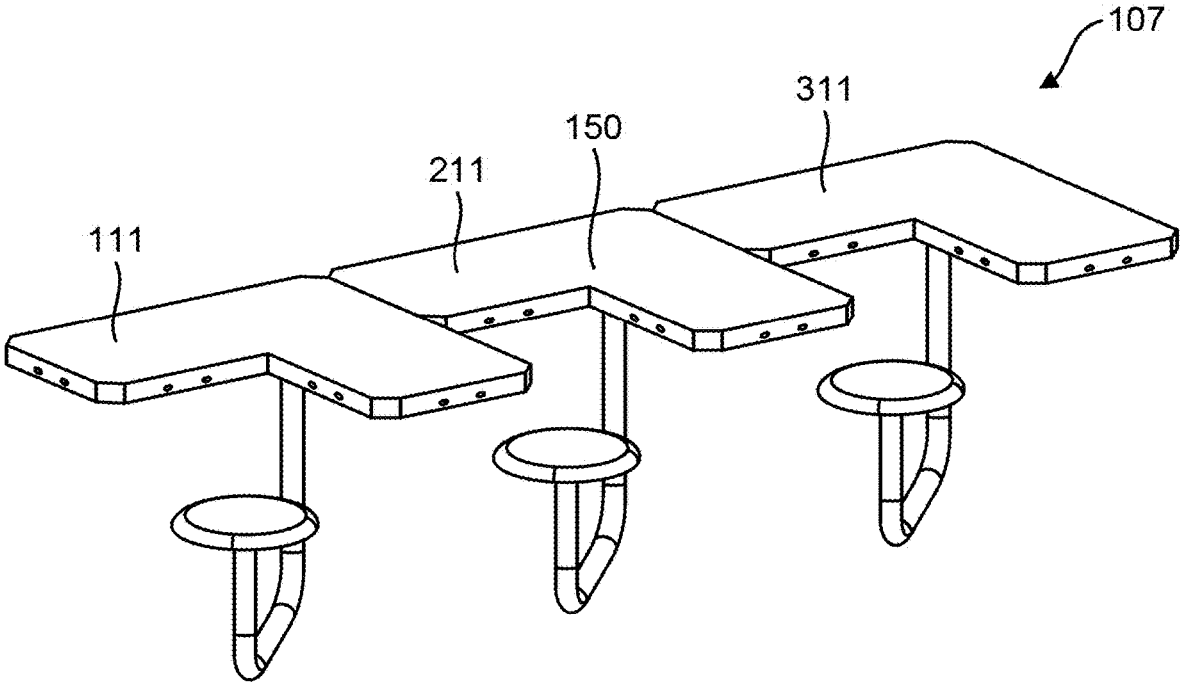
FIG. 12A is a perspective view of an embodiment of a modular table in accordance with an embodiment of the present disclosure.
Figure 12B:
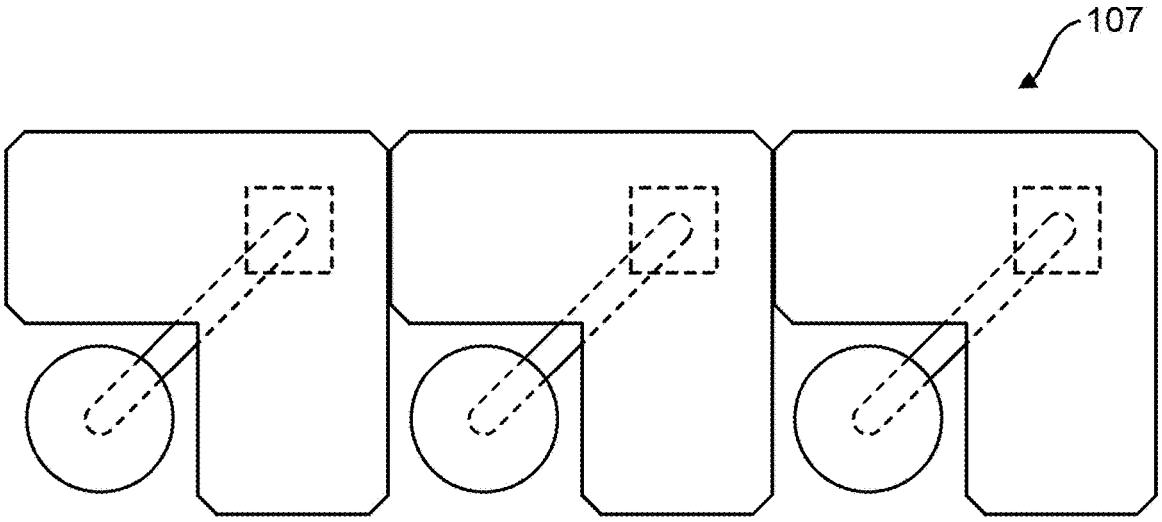
FIG. 12B is a top plan view of the embodiment of a modular table shown in FIG. 12A, showing the connections of the legs.
Figure 12C:
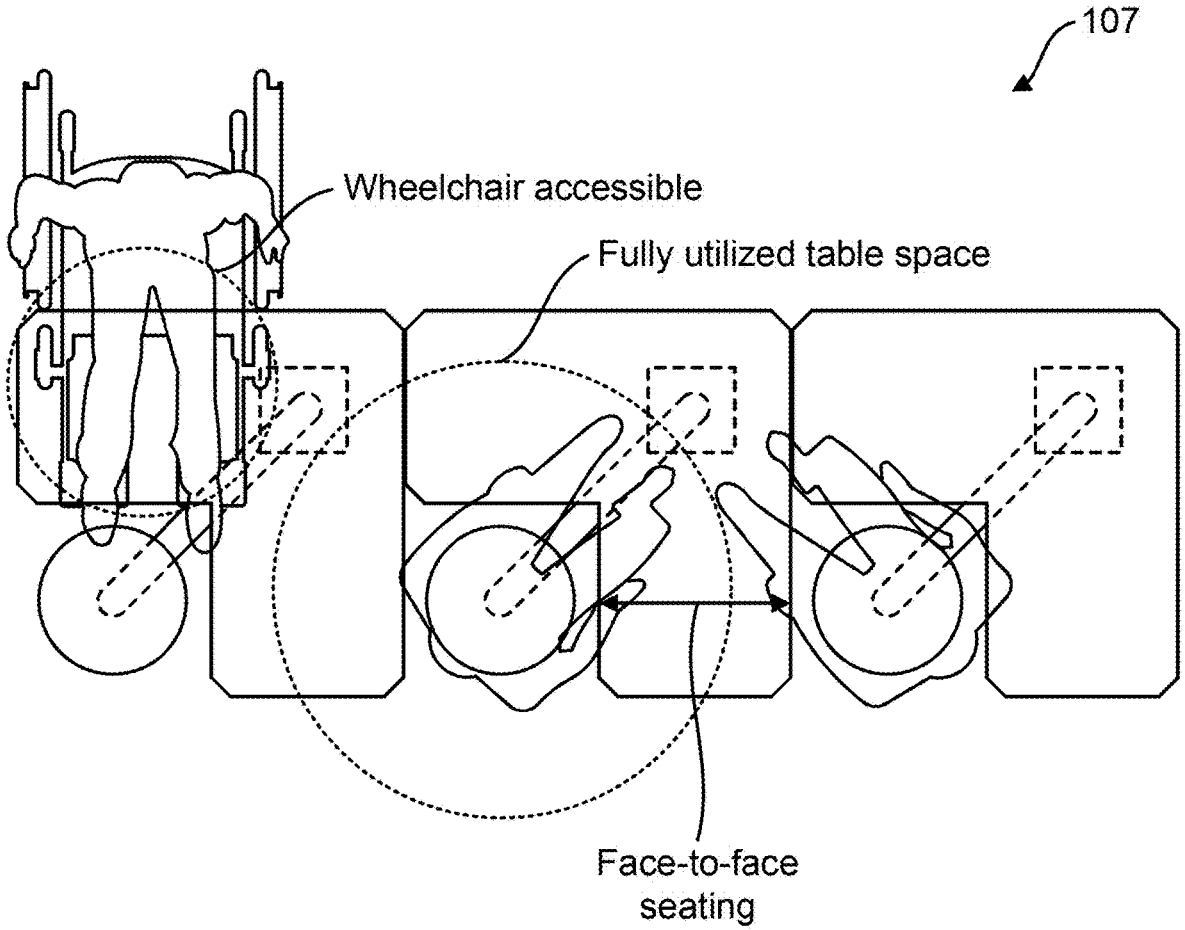
FIG. 12C is a top plan view of the embodiment of a modular table shown in FIG. 12A, showing potential seating locations and wheelchair accessibility points.

A seventh embodiment of a table, table 107 is shown in FIGS. 12A to 12C. Table 107 comprises "L"-shaped tabletop components 11, single-occupancy seats 31, and diagonal "J"-shaped legs 43. A plurality of "L"-shaped tabletop components 111, 211, 311 are attached in series, with an end edge 17 of the second "L"-shaped tabletop components 211 being attached to an outer edge 15 of the first "L"-shaped tabletop components via the side flanges 21 and so on in series. Each of the "L"-shaped tabletop components 111, 211, 311 is oriented in the same direction, such that all of the seats 31 are positioned on the same side of the resulting table surface 150. A single-occupancy seat 31 is positioned in the space formed by the inner side edges 16 of each tabletop component 111, 211, 311 using a diagonal "J"-shaped leg 43. Though the illustrated embodiment shows only three tabletop components 111, 211, 311 connected in series, more could be added to create a longer table.

Table 107 provides seats that can be used as a personal desk space or for face-to-face collaboration. Table 107 also provides wheelchair accessible seating locations at the outer edge 15 of each of the tabletop components 111, 211, 311, e.g. as shown in FIG. 12C.

Figure 13A:
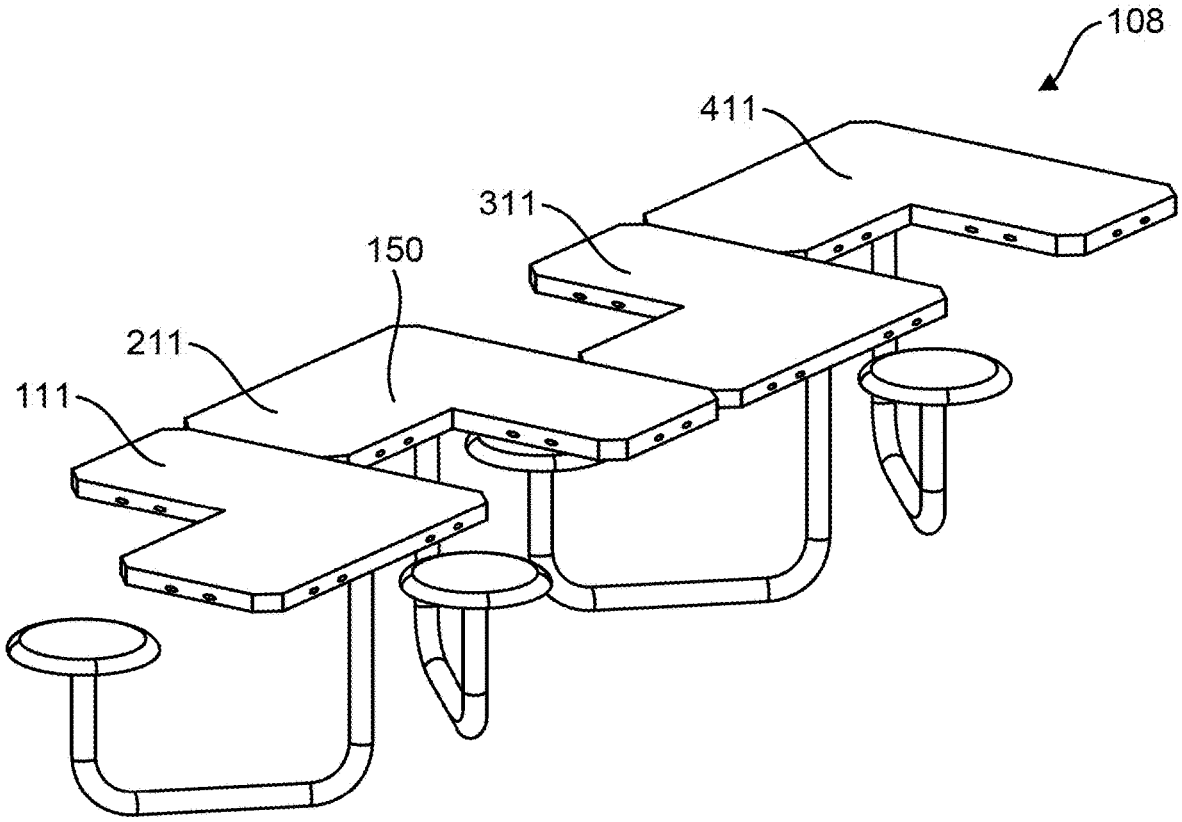
FIG. 13A is a perspective view of an embodiment of a modular table in accordance with an embodiment of the present disclosure.
Figure 13B:
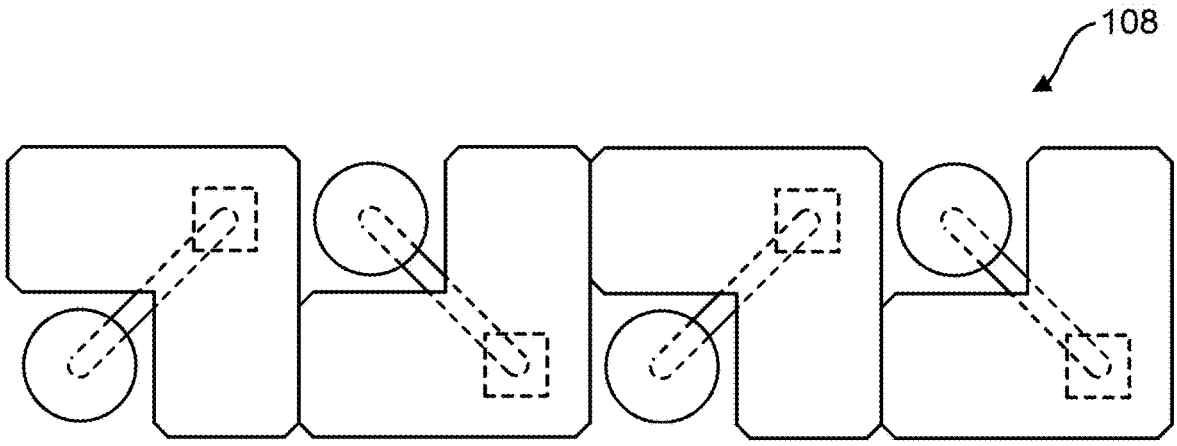
FIG. 13B is a top plan view of the embodiment of a modular table shown in FIG. 13A, showing the connections of the legs.
Figure 13C:
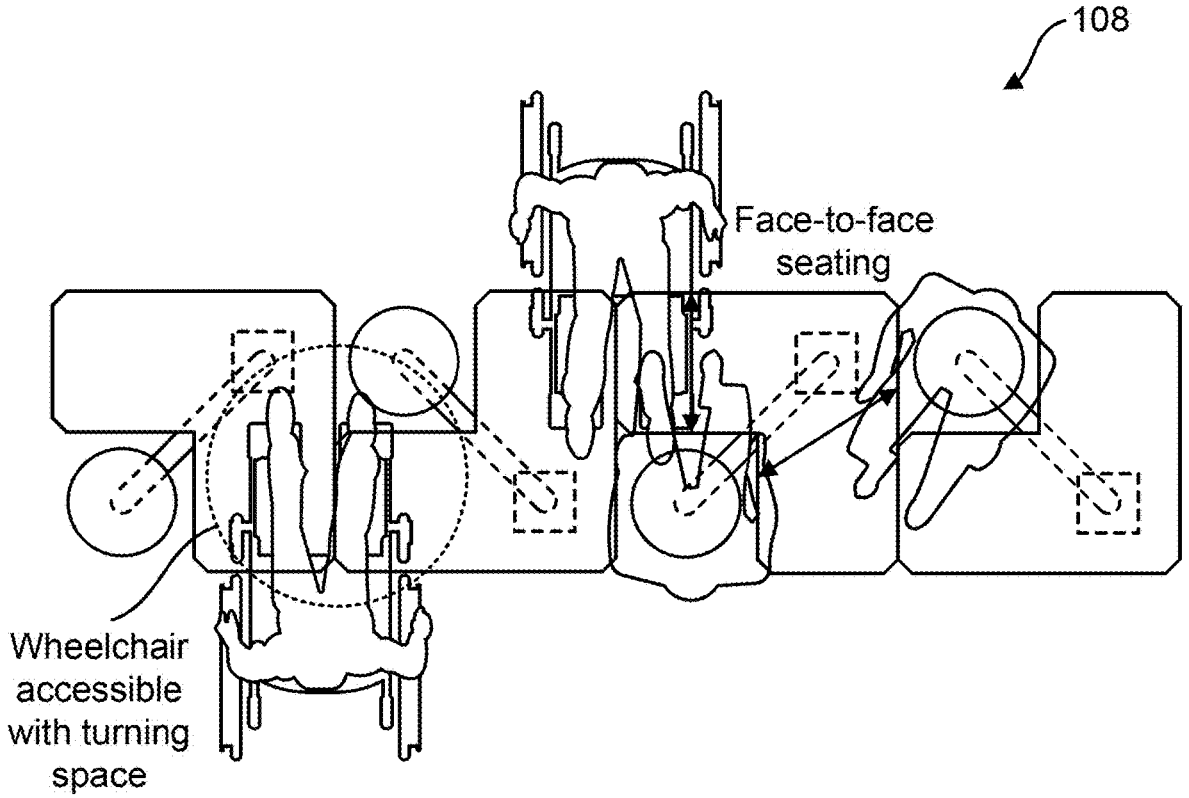
FIG. 13C is a top plan view of the embodiment of a modular table shown in FIG. 13A, showing potential seating locations and wheelchair accessibility points.

An eighth embodiment of a table, table 108 is shown in FIGS. 13A to 13C. Like table 107, table 108 comprises "L"-shaped tabletop components 11, single-occupancy seats 31, and diagonal "J"-shaped legs 43. Also like table 107, a plurality of "L"-shaped tabletop components 111, 211, 311, 411 are attached in series with an end edge 17 of the second "L"-shaped tabletop components 211 being attached to an outer edge 15 of the first "L"-shaped tabletop components via the side flanges 21 and so on in series. But unlike table 107, the orientation of every other "L"-shaped tabletop is rotated in table 108, such that the seats 31 are provided on alternating sides of the resulting table surface 150. A single-occupancy seat 31 is positioned in the space formed by the inner side edges 16 of each tabletop component 111, 211, 311, 411 using a diagonal "J"-shaped leg 43. Though the illustrated embodiment shows four tabletop components 111, 211, 311, 411 connected in series, more could be added to create a longer table or less could be utilized to create a shorter table.

Table 108 provides seats that can be used as a personal desk space or for face-to-face collaboration. Table 108 also provides wheelchair accessible seating locations at the outer edge 15 of each of the tabletop components 111, 211, 311, 411 e.g. as shown in FIG. 13C. It is believed that the staggered seating provides a more comfortable interaction between occupants of the seats 31.

Figure 14A:
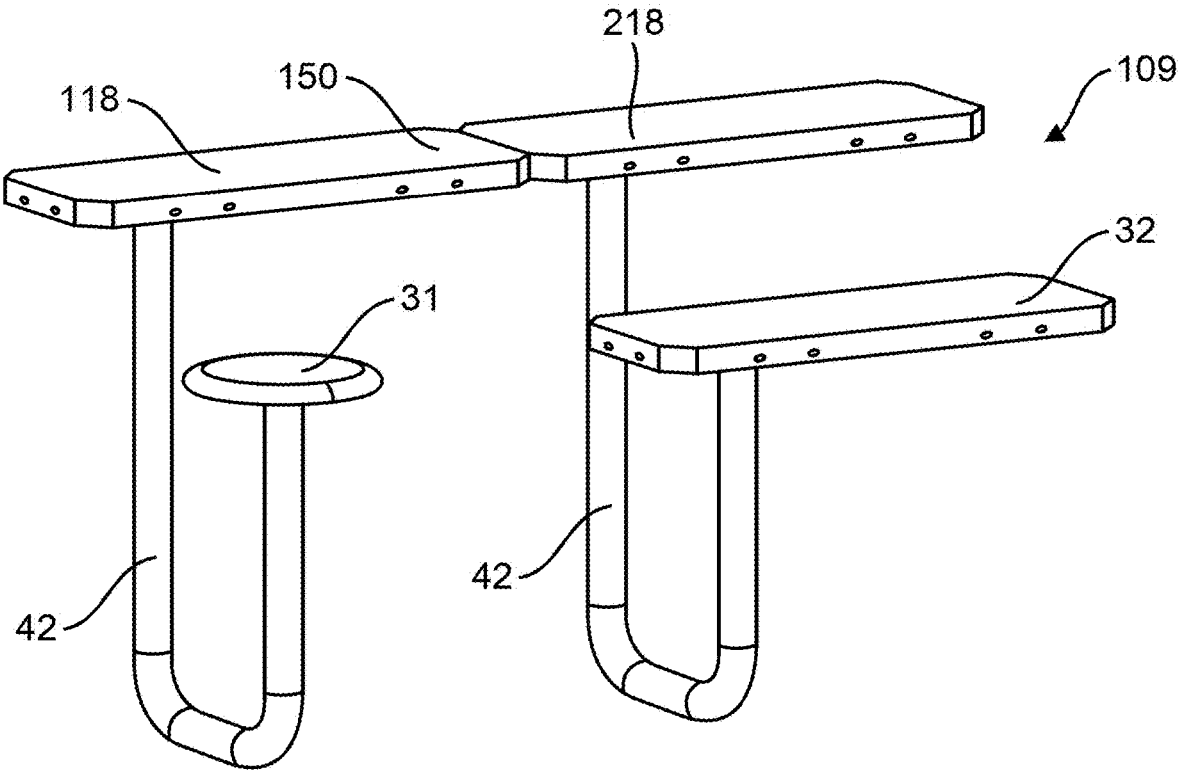
FIG. 14A is a perspective view of an embodiment of a modular table in accordance with an embodiment of the present disclosure.
Figure 14B:
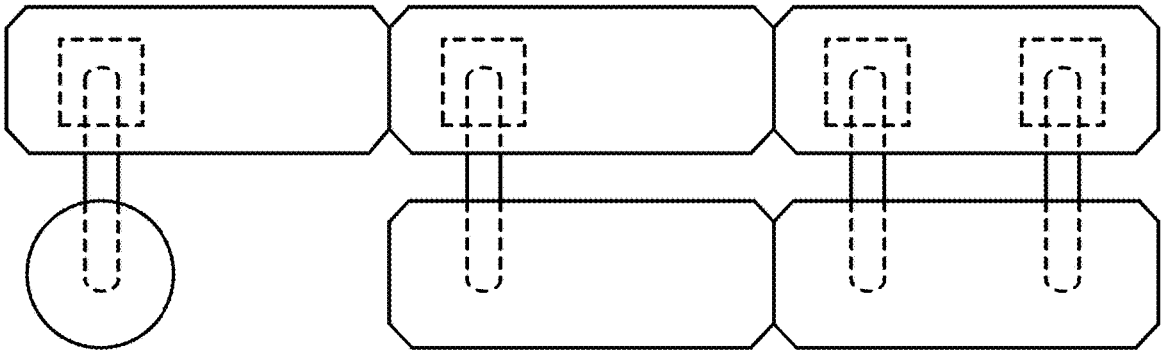
FIG. 14B is a top plan view of the embodiment of a modular table shown in FIG. 14A, showing the connections of the legs.
Figure 14C:
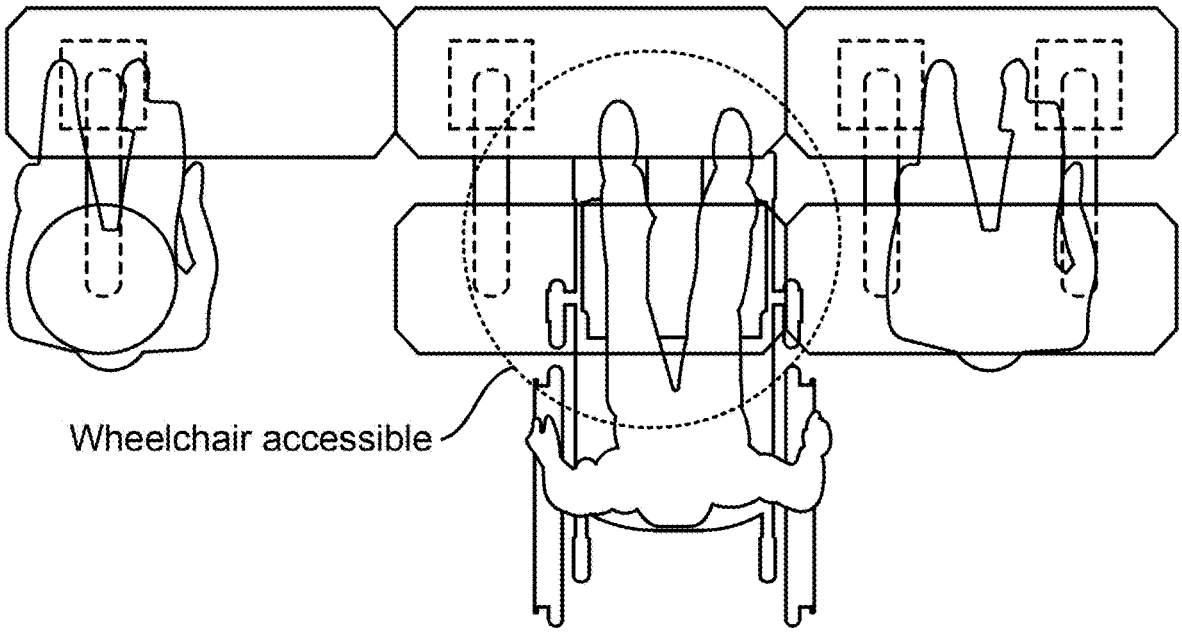
FIG. 14C is a top plan view of the embodiment of a modular table shown in FIG. 14A, showing potential seating locations and wheelchair accessibility points.

A ninth embodiment of a table, table 109 is shown in FIGS. 14A to 14C. Table 109 comprises rectangular tabletop components 18, one or more single occupancy seats 31, one or more bench seats 32, and "J"-shaped leg components 42. As noted above, the bench seats 32 and the rectangular tabletop components 18 may in fact be the same component. More particularly, a plurality of rectangular tabletop components 118, 218, and optionally 318 are attached to one another in series, with the end edges of adjacent tabletop components affixed via the side flanges 21. Either a single-occupancy seat 31 or a bench seat 32 is attached to each tabletop component 118, 218 via one or more (standing table height) "J"-shaped leg component 42. Though the illustrated embodiment shows three tabletop components 118, 218, 318 connected in series, more could be added to create a longer table or less could be utilized to create a shorter table. Moreover, the arrangement of single-occupancy seats 31 and bench seats 32 can be selected to suit any particular need.

The result is a long table surface 150 that can be positioned against and optionally mounted to a wall and that provides a variety of seating options. Further, as shown in FIG. 14C, by attaching a bench seat 32 to a tabletop component using only a single "J"-shaped leg 42 rather than two (with additional support coming from an additional attachment of the bench seat to an adjacent bench seat via the side flanges 21), space is provided for a person in a wheelchair to utilize the bench seat-which may be at conventional table height—as a table component.

Figure 15A:
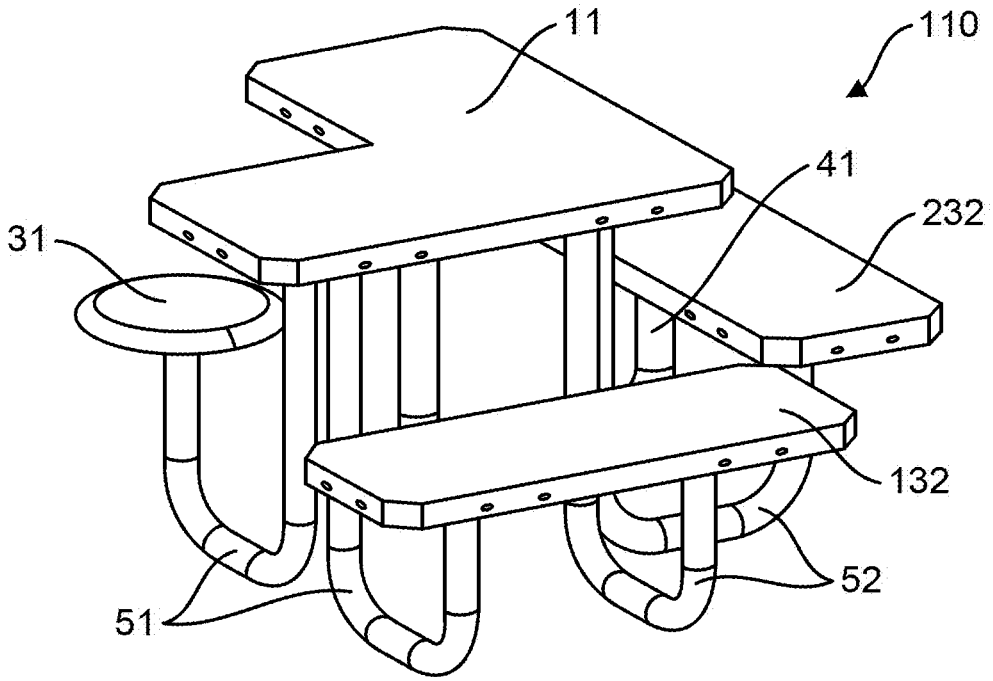
FIG. 15A is a perspective view of an embodiment of a modular table in accordance with an embodiment of the present disclosure.
Figure 15B:
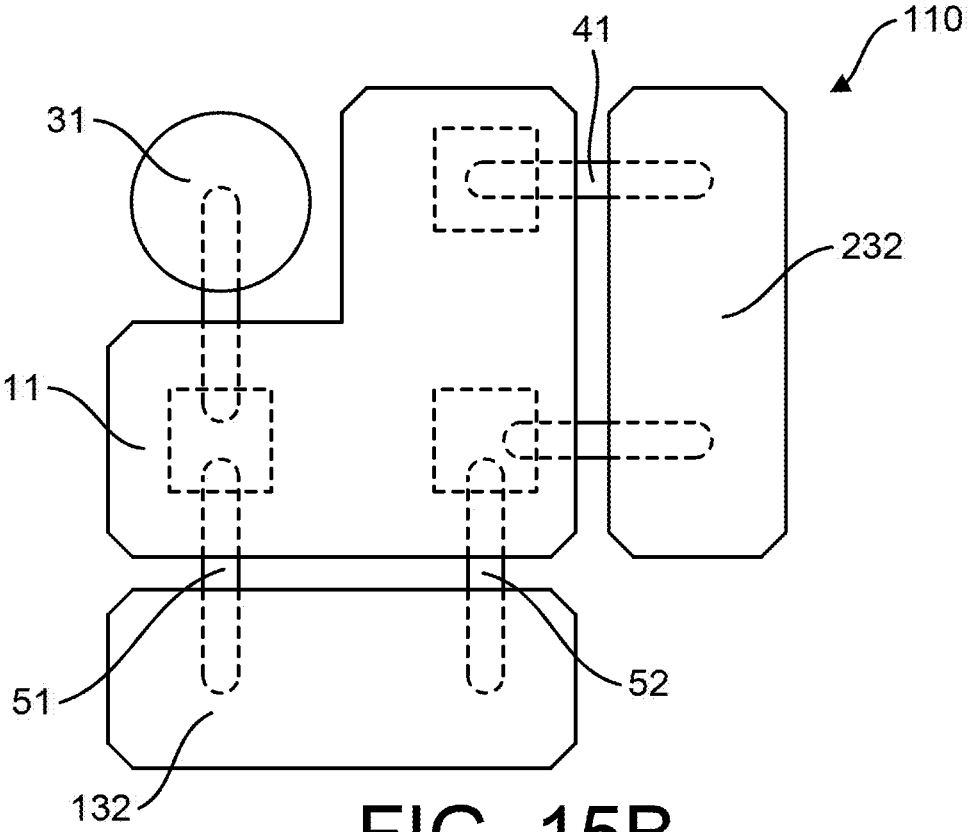
FIG. 15B is a top plan view of the embodiment of a modular table shown in FIG. 15A, showing the connections of the legs.
Figure 15C:
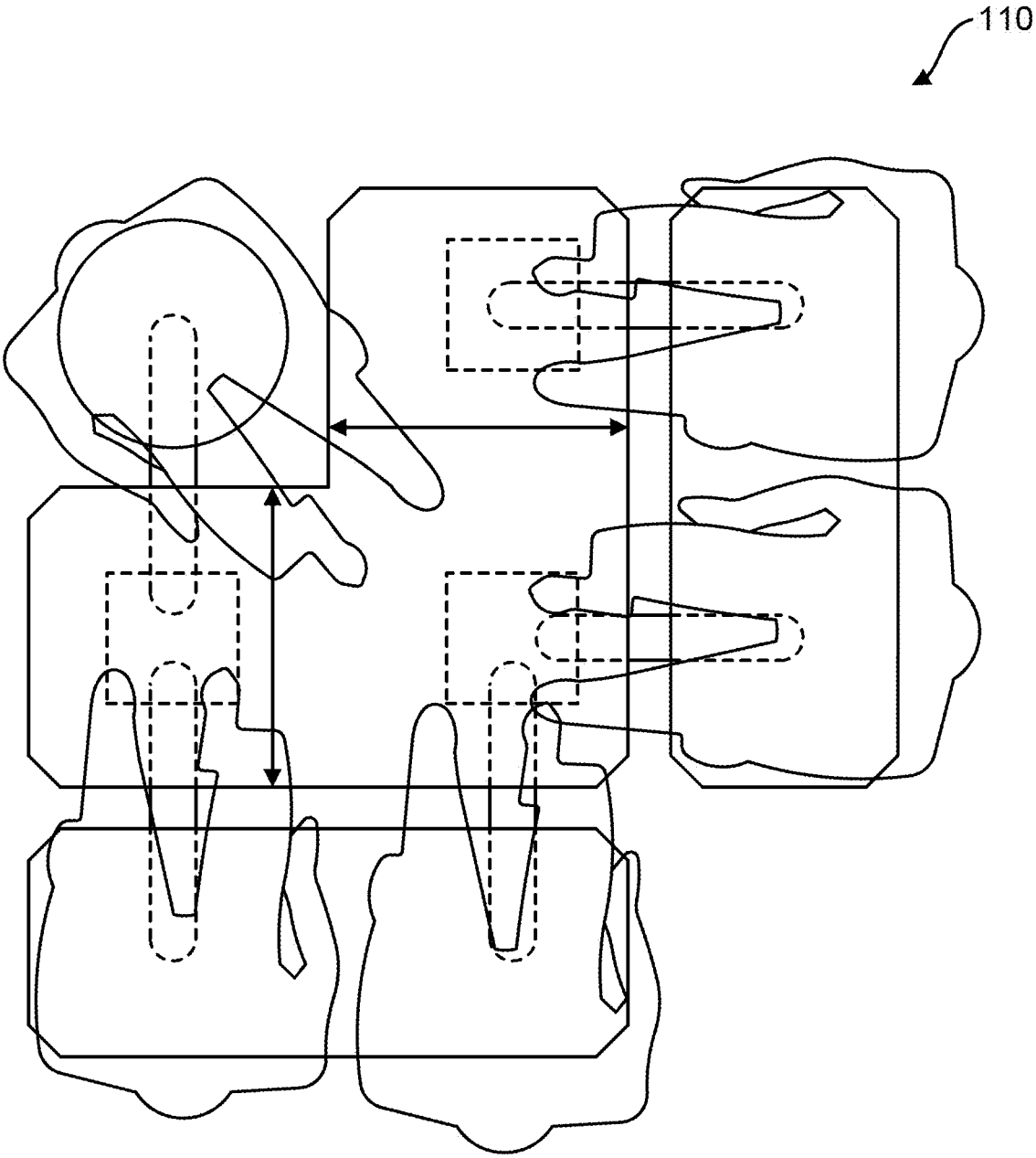
FIG. 15C is a top plan view of the embodiment of a modular table shown in FIG. 15A, showing potential seating locations.

A tenth embodiment of a table, table 110 is shown in FIGS. 15A to 15C. Table 110 comprises an "L"-shaped tabletop component 11, a single occupancy seat 31, a plurality of bench seats 32, a "J"-shaped leg component 41, a straight split leg component 51, and a right angle split leg component 52. The straight split leg component 51 is affixed to an underside of either the first or second wing portion of the tabletop component 11 and includes a first body 53 that supports a single-occupancy seat 31 at the inner side edge 16 of the wing portion and a second body 54 that partially supports a first bench seat 132 at the outer side edge 15 of the wing portion. The right angle split leg component 52 is affixed to an underside of the central portion of the tabletop component 11 and includes a first body 53 that partially supports the first bench seat 132 and a second body 54 that partially supports a second bench seat 232 at the outer side edge 15 of the other wing portion. Finally, a single leg component 41 is affixed to the other wing portion of the tabletop component and partially supports the second bench seat 232.

The resulting table 110 is perfect for a person, e.g. a teacher, sitting in the single-occupancy seat 31 to teach or present to a plurality of people, e.g. children, occupying the first and second bench seats 132, 232. Table 110 seats one presenter (e.g. teacher) and up to four observers (e.g. students) within a small space.

Figure 16A:
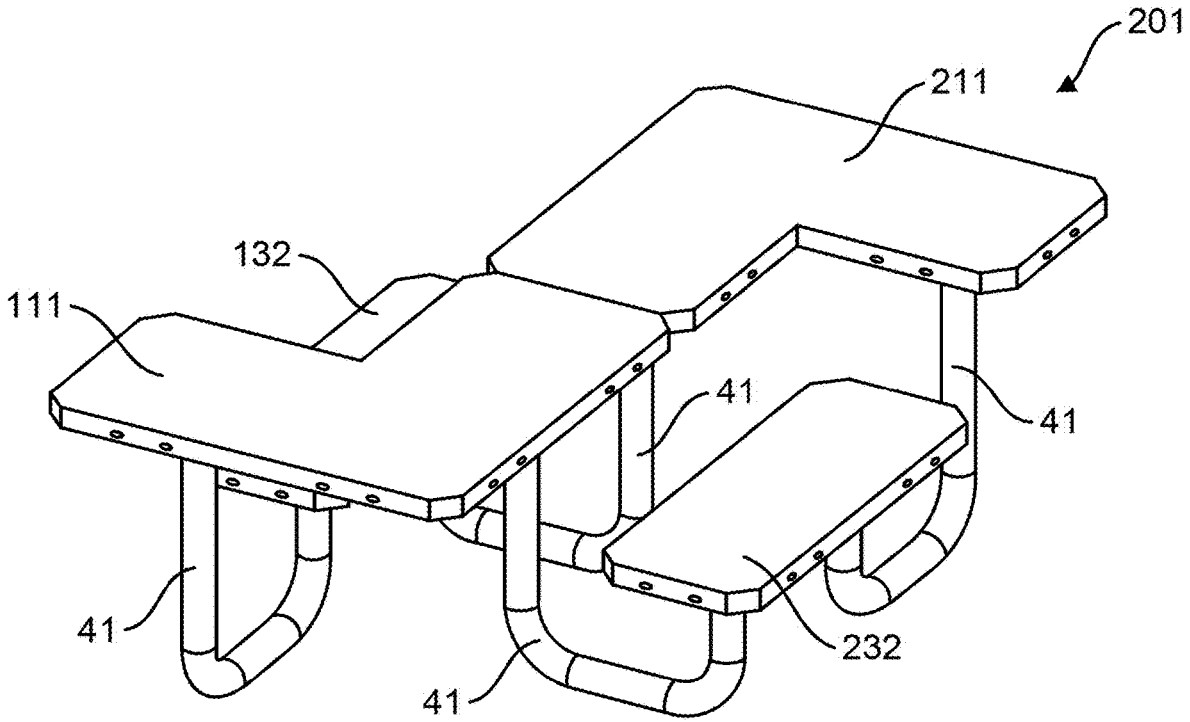
FIG. 16A is a perspective view of an embodiment of a modular table in accordance with an embodiment of the present disclosure.
Figure 16B:
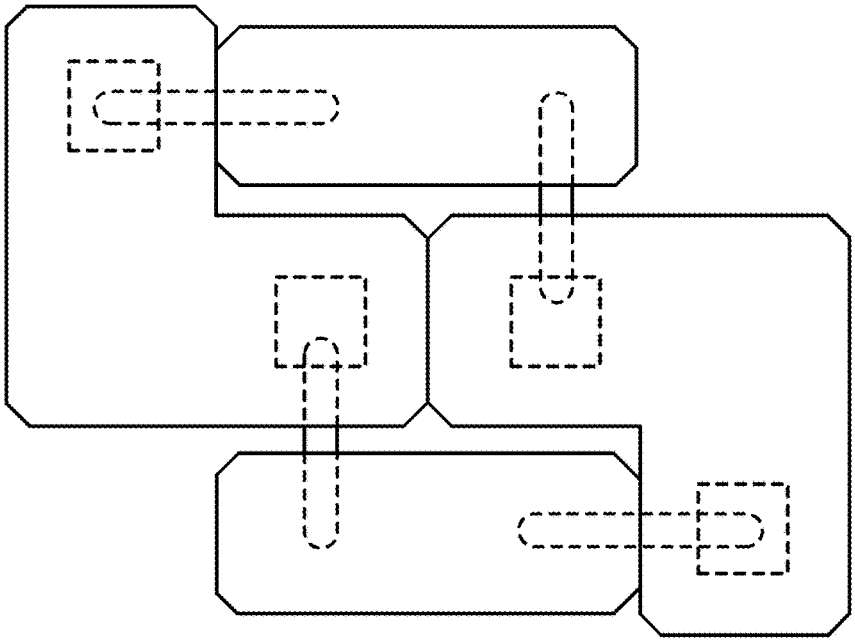
FIG. 16B is a top plan view of the embodiment of a modular table shown in FIG. 16A, showing the connections of the legs.
Figure 16C:
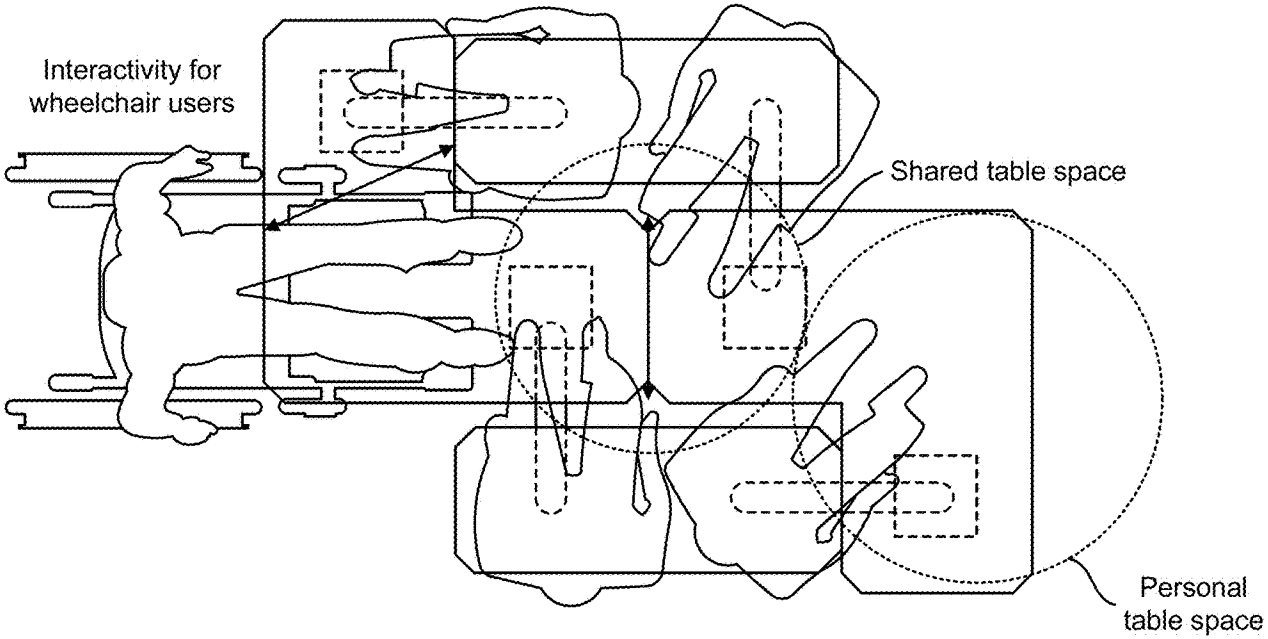
FIG. 16C is a top plan view of the embodiment of a modular table shown in FIG. 16A, showing potential seating locations and wheelchair accessibility points.

An eleventh embodiment of a table, table 201 is shown in FIGS. 16A to 16C. Table 110 comprises "L"-shaped tabletop components 11, bench seats 32, and "J"-shaped legs 41. More particularly, table 110 includes first and second "L"-shaped tabletop components 111, 211 which are affixed together via the side flanges 21 at end edges 17 of each tabletop component. The orientation of the second tabletop component 211 is opposite that of the orientation of the first tabletop component 111. A first bench seat 132 is attached to both the first tabletop component 111 through a first leg 41 and the second tabletop component 211 through a second leg 41. Similarly, a second bench seat 132 is attached to both the first tabletop component 111 through a first leg 41 and the second tabletop component 211 through a second leg 41.

The resulting table 201 provides a collaborative work area, e.g. that may be used for outdoor classroom work. Each bench seat 132, 232 is provided with a personal workspace to the side and a shared workspace in the center. Table 201 seats up to four on the bench seats 132, 232 and provides access for up to two persons in wheelchairs, e.g. as is shown in FIG. 16C.

Importantly, the tables 100 shown in the illustrated embodiments are intended as examples which show just some of the many table designs that can be assembled using the modular components of the present disclosure or a subset thereof. A person of skill in the art would understand that an almost limitless variety of tables of differing designs could be assembled using the set of modular components described herein.

It can be seen that the described embodiments provide unique and novel modular tables and sets of modular components configured to be assembled into those tables that have a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A modular table comprising:

a table top having a central portion, a first wing portion, and a second wing portion, each of the first and second wing portions extending from the central portion at a 90 degree angle to one another, such that the table top has an "L" shape;

one or more seating surfaces, each of the one or more seating surfaces being connected to the table top by a leg having a first end affixed to an underside of the table top and a second end affixed to an underside of the seating surface;

wherein the underside of the table top is configured for the first end of each of the one or more legs to be attached at any of a plurality of different locations.

2. The modular table of claim 1, wherein the leg comprises a first portion extending downward from the first end, a second portion extending downward from the second end, and a central portion of the leg that extends horizontally between the first and second portions and which is configured to rest on a ground surface.

3. The modular table of claim 1, wherein the first end of the leg comprises a mounting plate and the underside of the table top comprises a first rail to which a first side of the mounting plate is secured by one or more fasteners and a second rail to which a second, opposing side of the mounting plate is secured by one or more fasteners.

4. The modular table of claim 3, wherein the table comprises a first seating surface and a first leg, the first leg having a first end affixed to an underside of the table top and a second end affixed to an underside of the first seating surface; and a second seating surface and a second leg, the second leg having a first end affixed to an underside of the table top and a second end affixed to an underside of the second seating surface;

wherein the first end of the first leg and the first end of the second leg share a single mounting plate.

5. The modular table of claim 1, wherein at least one of the one or more seating surfaces is configured to support a single occupant.

6. The modular table of claim 5, wherein the seating surface configured to support a single occupant is positioned (i) in between the first and second wing portions, (ii) at an outer side of the first wing portion, or (iii at an outer side of the second wing portion.

7. The modular table of claim 5, wherein the seating surface configured to support a single occupant is positioned in between the first and second wing portions and wherein the first end of the leg is affixed to the underside of the tabletop at (i) the center portion, such that the leg forms an angle of about 45 degrees with both the first wing portion and the second wing portion;

(ii) the first wing portion, such that the leg extends parallel to the second wing portion; or (iii) the second wing portion, such that the leg extends parallel to the first wing portion.

8. The modular table of claim 1, wherein at least one of the one or more seating surfaces is configured to support multiple occupants.

9. The modular table of claim 8, wherein the seating surface configured to support multiple occupants comprises a first leg having a first end affixed to an underside of the table top and a second end affixed to an underside of the seating surface, and a second leg having a first end affixed to an underside of the table top and a second end affixed to an underside of the seating surface.

10. The modular table of claim 8, wherein the seating surface configured to support multiple occupants is positioned (i) along an outer side of the tabletop formed by a combination of the first wing portion and the central portion; or (ii) along an outer side of the tabletop formed by a combination of the second wing portion and the central portion.

11. The modular table of claim 1, comprising a first "L"-shaped table top, a second "L"-shaped table top, and a connector having a first end affixed to the first "L"-shaped table top and the second end affixed to the second "L"-shaped table top.

12. The modular table of claim 11, wherein the connector comprises a first portion extending downward from the first end, a second portion extending downward from the second end, and a central portion of the connector that extends horizontally between the first and second portions and which is configured to rest on a ground surface.

13. The modular table of claim 11, wherein the first end of the connector comprises a first mounting plate and the underside of the first table top comprises a first rail to which a first side of the first mounting plate is secured by one or more fasteners and a second rail to which a second, opposing side of the first mounting plate is secured by one or more fasteners; and the second end of the connector comprises a second mounting plate and the underside of the second table top comprises a first rail to which a first side of the second mounting plate is secured by one or more fasteners and a second rail to which a second, opposing side of the second mounting plate is secured by one or more fasteners.

14. The modular table of claim 11, wherein the first "L"-shaped table top is positioned at a first height, the second "L"-shaped table top is positioned at a second height, and the second height differs from the first height by at least eight inches.

15. The modular table of claim 14, wherein the first "L"-shaped table top and the second "L"-shaped table are oriented such that, viewed from above the first and second table tops form a rectangular shape.

16. The modular table of claim 15, wherein the first "L"-shaped table top comprises a seating surface configured to support multiple occupants; and the second "L"-shaped table top comprises a seating surface configured to support a single occupant.

17. The modular table of claim 14, wherein the second height differs from the first height by about twelve inches.

18. The modular table of claim 14, wherein the second "L"-shaped table top is positioned at a height that is configured for use by a person in a wheelchair, and wherein at least one side of the second "L"-shaped table top is free of obstructions such a person in a wheelchair can position his or her legs under the table top.

19. The modular table of claim 1, comprising a first "L"-shaped table top and a second "L"-shaped table top, wherein each of the first and second "L"-shaped table tops comprises side edges that each includes one or more apertures; and wherein a side edge of the first "L"-shaped table top and a side edge of the second "L"-shaped table top are secured together by one or more fasteners extending through the one or more apertures of the side edges.

20. The modular table of claim 19, wherein each of the first and second "L"-shaped table tops comprises one or more seating surfaces, each of which is connected to the table top by a leg having a first end affixed to an underside of the table top and a second end affixed to an underside of the seating surface;

wherein each leg comprises a first portion extending downward from the first end, a second portion extending downward from the second end, and a central portion of the leg that extends horizontally between the first and second portions and which is configured to rest on a ground surface; and wherein the central portion of the legs are the only surfaces of the modular table in contact with the ground surface.

* * * * *